US006875137B2

(12) United States Patent
Forsythe et al.

(10) Patent No.: US 6,875,137 B2
(45) Date of Patent: Apr. 5, 2005

(54) RECONFIGURABLE BALL BAT AND METHOD

(75) Inventors: Paul D. Forsythe, Phoenix, AZ (US); Douglas M. Hoon, Guilford, CT (US)

(73) Assignee: HoonForsythe Technologies LLC, Phoenix, AZ (US)

( * ) Notice: Subject to any disclaimer, the term of this patent is extended or adjusted under 35 U.S.C. 154(b) by 0 days.

(21) Appl. No.: 10/622,717

(22) Filed: Jul. 17, 2003

(65) Prior Publication Data

US 2004/0224802 A1 Nov. 11, 2004

Related U.S. Application Data

(63) Continuation-in-part of application No. 10/434,553, filed on May 8, 2003.

(51) Int. Cl.[7] ..... A63B 59/06
(52) U.S. Cl. ..... 473/566; 473/567
(58) Field of Search ..... 473/457, 519, 473/520, 564–568

(56) References Cited

U.S. PATENT DOCUMENTS

| | | | | |
|---|---|---|---|---|
| 546,540 | A | | 9/1895 | Kennedy |
| 1,509,733 | A | | 9/1924 | Langford |
| 3,116,926 | A | * | 1/1964 | Owen et al. ..... 473/457 |
| 3,173,688 | A | | 3/1965 | Green |
| 3,224,769 | A | | 12/1965 | Nickell |
| 3,877,698 | A | | 4/1975 | Volpe |
| 4,274,631 | A | | 6/1981 | Hayazaki |
| 4,682,773 | A | | 7/1987 | Pomilia |
| 4,720,104 | A | | 1/1988 | DiSieno |
| 4,907,800 | A | | 3/1990 | Passamaneck et al. |
| 5,114,144 | A | * | 5/1992 | Baum ..... 473/567 |
| 5,133,551 | A | | 7/1992 | Handy et al. |
| 5,219,164 | A | * | 6/1993 | Peng ..... 473/520 |
| 5,277,421 | A | * | 1/1994 | Rewolinski ..... 473/457 |
| 5,360,209 | A | | 11/1994 | Mollica |
| 5,409,214 | A | | 4/1995 | Cook |
| 5,415,398 | A | | 5/1995 | Eggiman |
| 5,590,875 | A | | 1/1997 | Young |
| 5,676,609 | A | | 10/1997 | Mollebaek |
| 5,820,438 | A | | 10/1998 | Horton, III |
| 5,899,823 | A | | 5/1999 | Eggiman |
| 5,954,602 | A | | 9/1999 | Eggiman et al. |
| 6,050,908 | A | * | 4/2000 | Muhlhausen ..... 473/457 |
| 6,099,422 | A | | 8/2000 | Rappaport et al. |
| 6,152,840 | A | | 11/2000 | Baum |
| 6,251,034 | B1 | | 6/2001 | Eggiman et al. |
| 6,383,101 | B2 | | 5/2002 | Eggiman et al. |
| 6,398,675 | B1 | | 6/2002 | Eggiman et al. |
| 6,406,387 | B1 | * | 6/2002 | Ryan ..... 473/457 |
| 6,432,006 | B1 | | 8/2002 | Tribble |
| 6,443,860 | B1 | | 9/2002 | Byrne et al. |

(Continued)

FOREIGN PATENT DOCUMENTS

JP 402264678 A 10/1990

*Primary Examiner*—Mark S. Graham
(74) *Attorney, Agent, or Firm*—Schmeiser, Olsen & Watts, LLP

(57) ABSTRACT

A ball bat configured to allow the removal and replacement of a barrel assembly for enabling selection of a barrel having particular performance characteristics or if the barrel is damaged. The barrel assembly may be selectively changed to meet certain regulation requirements. A bat component can also include a ballast for selectively providing the ball bat with a particular weight. The ballast can be provided as a tube of thin film in the barrel assembly. The thin film ballast tube also forms a tamper resistant shield to inhibit modification of components inside the barrel section. One or more components of the ball bat can be provided as a kit. The kit may be a barrel assembly kit. The ball bat can be made by forming and assembling the components simply and inexpensively. Some or all of the components can be separably combined during assembly.

46 Claims, 18 Drawing Sheets

U.S. PATENT DOCUMENTS 6,471,607 B2 10/2002 Hsu
6,482,114 B1 11/2002 Eggiman et al.
6,485,382 B1 * 11/2002 Chen ..... 473/566
6,497,631 B1 12/2002 Fritzke et al.
6,511,392 B1 1/2003 Chohan
2002/0055402 A1 * 5/2002 Ciesar et al. ..... 473/457
2002/0072436 A1 * 6/2002 Liu ..... 473/457
2003/0069095 A1 * 4/2003 Turos ..... 473/457
2003/0114257 A1 * 6/2003 Mabry ..... 473/457

* cited by examiner

RECONFIGURABLE BALL BAT AND METHOD

This application is a continuation-in-part of U.S. patent application Ser. No. 10/434,553 filed May 8, 2003 and entitled "BASEBALL BAT WITH REPLACEABLE BARREL", which is incorporated herein by reference.

BACKGROUND OF THE INVENTION

1. Technical Field

This invention generally relates to baseball and softball bats and, more particularly, to reconfigurable bats that allow for the replacement of the barrel should a different level of performance be desired or should the barrel become damaged.

2. Background Art

The disclosures and inventions of the past are deficient in teaching the use of a bat with a barrel section that may be removed from the bat and replaced with a different barrel section when a change in the performance characteristics of the bat is required or when the barrel section becomes damaged. Rather, the approaches of the past address the issues of performance and durability by trading-off one against the other in an attempt to achieve a balance which the user might appreciate.

The designers of baseball and softball bats have had as a primary object, a bat that can hit a ball long distances. Designers have as a secondary object, a bat which is durable and can survive repeated impacts with the ball. It is difficult to accomplish one of these objectives without compromising the other.

The characteristics of a bat are very largely determined by the types of materials and the geometry of the components including a thickness of the barrel section of the bat. Depending upon the performance and/or durability desired, the bat may be very durable or easily susceptible to damage during play. Likewise, a bat's performance, measured by the batted ball speed, may be high or low. Most high performance bats manufactured today are hollow. They rely upon the deformation of the barrel wall, principally in the hoop mode, to provide a so-called "trampoline effect" which leads to higher batted ball speeds. Bats of this construction can be as much as 50% more efficient than solid wood bats. That is, the batted ball speed can be as much as 50% higher for hollow bats than for wooden bats. Because such high performance gives an advantage to the batter, most players prefer to use a bat with as high a performance rating as possible. Higher batted ball speeds, however, put the pitcher and other infielders at some risk of being struck by a ball traveling so rapidly that they have insufficient time to react. To protect players in the infield, bat performance is generally regulated. To be competitive, bats must perform at or near these regulated limits. However, even to achieve these regulated limits, barrel walls must generally be thinned to the point that durability becomes an important issue. It is common, among the highest performing population of bats, especially in the hands of good athletes, for these bats to be damaged within 50–500 impacts. This damage renders the bats of the past unsuitable for further use.

The first bats ever produced were made from solid wood and were of one piece construction. This design endured without significant change for about ¾ of a century until hollow aluminum bats were introduced. These aluminum bats and subsequent composite bats have followed the original wooden bats in form except for their hollow construction. Designers have continued to struggle with the tradeoff between performance and durability. Their solutions have been deficient in many regards.

Numerous solutions have been proposed for improving durability, all with varying degrees of success. In each case, efforts to improve the durability of the bat generally result in a reduction in performance. The liveliness of the bat, principally resulting from the so-called "trampoline effect" is closely tied to the stiffness of the barrel section of the bat. To some degree, reducing stiffness increases the trampoline effect and vice-versa. Increasing thickness of the barrel wall quickly increases the bending stiffness of the wall, allowing the wall to deform less, and reducing the trampoline effect as a result. Another shortcoming resulting from these durability increasing approaches is an increase in the bat's weight and its polar moment of inertia, both making the bat more difficult to swing rapidly and decreasing the batter's ability to hit the ball well.

DISCLOSURE OF THE INVENTION

The present invention relates to a baseball or softball bat that is provided with a means to quickly and easily remove and replace the barrel section of the bat by one of a variety of different barrel sections configured for different levels of performance and durability depending upon the batter's level of play and the rules of the game in which the bat is being used. This aspect of the invention also allows replacement of the barrel section whenever it has become damaged, whether through contact with the ball as occurs in the normal course of play, or otherwise.

The invention includes the idea of accepting limited durability in exchange for higher performance without investing in a bat that is prone to irreparable failure. The practical application of this idea enables an end user to easily and affordably choose between more or less performance and more or less durability as the situation demands. In case of failure of a particular barrel section, the barrel section can simply be replaced without the loss of the complete bat. Specifically, the invention enables a batter to modify the performance level of a bat, either to a higher or a lower level, based upon his or her ability level and based upon the rules of the game as imposed by local or national rules making bodies. In fact, a bat can be modified to enable its use in both softball and baseball.

Furthermore, a bat of the present invention can be modified for several levels of play. For example, a first highest level may be defined in terms of the intended function of hitting the ball as far as possible, or a home run level. A second intermediate level of performance may be defined by its intended function of enabling a hitter to make a base hit. A barrel having characteristics for this intermediate level of performance may be useful for cases in which the maximum number of home runs has been achieved in a given game, and a reduced performance is desired to avoid additional home runs. A third lower level of performance for a practice or swing bat has even lower performance, but is much more durable. A fourth level of performance is specifically configured to be more durable in cold weather conditions. Thus, there is disclosed herein means for quickly and easily replacing a barrel section of a softball or a baseball bat to selectively modify a performance level of the bat.

The invention also includes enabling these modifications to be made quickly, by the bat owner, without need to return the bat to a manufacturer, dealer, or other third party. Related to this feature, the components can be of low complexity that can be easily manufactured in mass or lots so that the components can be kept in stock to be readily available.

Alternatively, extra components can be kept by the user. Thus, replacement of the components including the barrel section to return a bat to a state of playability is easy and inexpensive.

In one aspect, the barrel section is replaced by removing a barrel assembly and installing a different barrel assembly. The barrel assembly in this case may include a barrel section, an end cap, a transition piece, and a ballast. The replacement barrel assembly can be acquired as separate pieces that can be assembled prior to or during installation on the bat. Having the barrel assembly initially in parts provides the advantage of enabling mix and match of a variety of different components.

An example of a bat that implements the invention accordingly in a simple form is a reconfigurable ball bat having a center tube with a first diameter and a first length extending between a proximal end and a distal end of the center tube. The bat further includes a transition piece mounted on the center tube at a position spaced from the proximal end of the center tube. The minimum diameter of the transition piece bearing surface is greater than or equal to approximately twice the first diameter. In one aspect, the transition piece has a bearing surface with a minimum diameter in the range from 2 to 3½ times the first diameter. The bat also has a barrel with a proximal end including a proximal bearing surface. The proximal bearing surface has a minimum diameter greater than or equal to approximately twice the first diameter. In one aspect, the proximal bearing surface has a minimum diameter in the range from 2 to 3½ times the first diameter. In the assembled state, the proximal bearing surface of the barrel is solely in contact with the bearing surface of the transition piece so that structural contact only occurs at a diameter equal to or greater than approximately twice the first diameter. In one aspect, the structural contact between the barrel and the transition only occurs at a diameter in the range from 2 to 3½ times the first diameter.

In one aspect of the invention, structural components that hold the barrel on the transition piece can include the center tube being connected to the end cap. One way this can be achieved is by connecting an end plug to a distal end of the center tube. An end cap is also provided and abutted with a distal end of the barrel. An assembly screw engages in the end plug and holds the end cap on the distal end of the barrel. In this way, the end cap provides a coupler at a distal end of the barrel. Thus, the coupler removably mounts the barrel on the transition piece.

In another aspect of the invention, the coupler is one of a plurality of couplers. Some of these couplers can be interchanged on a given bat. The couplers can have barrel engaging bearing surface minimum diameters in the range from approximately 2 to approximately 3½ times the diameter of the center tube so that a coupler can be selected to accommodate a selected barrel. This aspect of the invention highlights the reconfigurability of the bats of the invention. This reconfigurability lends itself to another aspect of the invention, which is that one or more component of a bat can be packaged or provided as a kit.

While the kit may include as few as one component, typically the kit would include more than one component including assembly instructions. For first time purchases, the kit would normally include a complete ball bat. In this case, the reconfigurable ball bat kit would include a center tube, at least one transition piece, and at least one barrel. This kit may have the barrel selectively connectable and separable from the center tube. The kit may further include a plurality of barrels that are selectively supported on the center tube by the transition piece.

Another aspect of the invention is a method of using the reconfigurable ball bat. This method entails selecting a component to replace an existing component on the reconfigurable bat. As such, the invention more specifically includes selecting a replacement barrel to replace an existing barrel. The replacement barrel is supported on the center tube by at least one transition. Added advantages are further provided when the replacement barrel is selected from among a plurality of barrels.

In another aspect, the invention includes a method of making a ball bat. This method includes forming a center tube to have a first inner diameter and a first outer diameter. Making the ball bat also includes forming a transition piece with an outer surface including a barrel abutting bearing surface and an opening having an inner surface. A dimension of the inner surface matingly receives the first outer diameter of the center tube. Another step in the method of making is forming a barrel having a second outer diameter and a second inner diameter. The second inner diameter is made to match the barrel abutting bearing surface on the outer surface of the transition piece so that the barrel fits on the barrel abutting bearing surface. The various components of the ball bat are assembled by connecting the transition piece to the center tube and the barrel to the barrel abutting bearing surface of the transition piece.

In one aspect of the method of making, the step of connecting the barrel to the transition piece is facilitated by providing an end cap for the ball bat. The end cap is connected to a distal end of the barrel. The end cap supports the barrel on the transition by also being connected to the center tube. To this end, an end plug is formed and connected to a distal end of the center tube. An assembly screw or nut is provided and used for connecting the end cap to the barrel by engaging the screw or nut with the end plug. Alternatively stated, connecting the barrel to the transition piece can be accomplished by abutting a proximal end of the barrel with the barrel abutting bearing surface of the transition piece, abutting the end cap with the distal end of the barrel, and clamping the barrel between the transition piece and the end cap. The clamping action is effected by engaging the assembly screw or nut with the end plug and turning the assembly screw or nut.

It is to be understood that in all aspects of the invention set forth above, the barrel is removably mounted to the transition piece by structure that can be manipulated by hand or with a tool so that the barrel can be removed and replaced quickly and easily. In another aspect, the invention has structure on one or more of the center tube, the transition piece, and the barrel enabling simple manipulation so that the bat can be assembled and disassembled quickly and easily in a dugout or on the field, for example.

In another aspect, the invention includes a reconfigurable ball bat in a range of standard sizes for baseball and softball. This ball bat includes a handle portion, a barrel section removably connected to the handle portion, and a butt end supported on the barrel. This bat, assembled with a knob supported on the handle portion, has a length within the range of standard sizes for ball bats. Furthermore, the bat meets all the standards for ball bats established by at least one recognized official regulating organization such as the NCAA or ASA, for example. These standards commonly include a weight requirement in ounces equal to the length of the bat in inches minus at least three. In this aspect, the reconfigurable ball bat has all the couplers and structural elements to securely hold the various components together. Yet the reconfigurable ball bat can weigh less than or equal to thirty ounces, which is approximately the practical upper weight limit for competitive standard bats. In some configurations the bat weighs less than or equal to 28 or 26 ounces respectively. In still further configurations, the ball bat weighs in a range from 22 to 24 ounces. These advantageous characteristics are provided in part by incorporating light weight materials in the bats of the present invention as will be further described below.

To provide reassurance that the bats of the present invention meet and will continue to meet the established regulations of a given organization, the bats of the present invention include at least one of the handle portion, the barrel section, and the butt end that is removably connected to the rest of the bat so that the bat can be easily and quickly taken apart for inspection and put back together on the field.

Furthermore, the invention in any of its forms can include a tamper resistant element for connection to the center tube or to the barrel section. The tamper resistant element inhibits tampering with the center tube and/or barrel without obvious modification to the tamper resistant element. Thus, if a user attempts to modify the bat by adding or removing material from the center tube or barrel section, a noticeable modification of the tamper resistant element will occur. An official may take the bat apart and inspect it to detect any such tampering.

The tamper resistant element can be an enclosing seal covering otherwise open ends of a barrel, for example. Alternatively, the tamper resistant element can be configured as a tube or sleeve surrounding a center tube, or covering an inner surface of a barrel section. Typically, this tamper resistant element will be flexible, and generally will not contribute substantially to the structural strength of the bat. However, the tamper resistant element can provide an advantageous function of selectively adding a predetermined amount of weight at a predetermined location. For example, a tubular sleeve of a predetermined thickness and weight can extend along the center tube as a protective layer and a weight adding ballast.

In one aspect of the invention the reconfigurable ball bat has a center tube including a handle portion and a barrel assembly. The barrel assembly includes a transition piece, an end cap, and a barrel. The barrel is removably connected to the end cap at a distal end of the barrel and to the transition piece at a proximal end of the barrel. Notably, the barrel assembly is removably supported as a unit on the center tube by the transition piece and the end cap. The reconfigurable ball bat further has an end plug fixed in a distal end of the center tube. The end plug has a body in the form of a shaft and a head connected to the body. The head protrudes from the distal end of the center tube in order to engage with the end cap. In this way the end plug keeps the barrel assembly from moving distally off the center tube.

In another aspect of the reconfigurable ball bat, each of the end cap and the transition piece has an engagement structure. A ballast engages the engagement structure on each of the end cap and the transition piece. The ballast may be in the form of a tubular member that is disposed between the barrel and the center tube. In this way, the ballast can be generally coextensive with the barrel and the center tube inside the barrel. Thus when the barrel assembly is mounted on the center tube, the ballast seals an inner surface of the barrel and surrounds the center tube. Since all of the elements of the barrel assembly are integrally connected to each other the barrel assembly is removably mounted, and is also removable as a unit. Not only does the ballast seal the inside of the barrel and surround the center tube, the ballast also acts to provide weight to the reconfigurable ball bat. The ballast can be a non-strengthening member that is formed of a thin film material. The thickness of the film depends upon the amount of weight to be added to the reconfigurable ball bat. For most applications, it is desirable to keep ball bats to weights less than or equal to thirty ounces. Therefore, the ballasts used in the barrel assemblies will be relatively light in weight enabling the reconfigurable bat of the present invention to be competitive with bats of weights and lengths that are currently high in demand. Furthermore, it is to be understood that bats of thirty ounces and less are generally within the requirements of the official rule making bodies. In another aspect of the invention the reconfigurable ball bat includes a plurality of barrel assemblies. In this case, the plurality of barrel assemblies have predetermined variety of weights and playability characteristics.

In another aspect, the invention includes a reconfigurable ball bat kit. In particular, this reconfigurable ball bat kit includes at least one barrel assembly. As set forth above the barrel assembly of the kit includes a barrel, an end cap adapted to be supported on the barrel, a transition piece adapted to be supported on the barrel and removably supported on a handle portion of the ball bat, and a ballast adapted to be supported on the end cap and on the transition piece inside the barrel. As can be appreciated, the kit can include a plurality of barrel assemblies. Advantageously, each of the plurality of barrel assemblies has a different weight and/or a different playability characteristic from at least another of the barrel assemblies.

In another aspect of the invention a method of using a reconfigurable ball bat includes selecting a barrel assembly in accordance with a desired weight and/or playability of the barrel assembly. In particular, the barrel assembly is selected from among a plurality of barrel assemblies based on a desired weight and playability characteristic. The method of using the reconfigurable ball bat also includes supporting the selected barrel assembly on the center tube of the reconfigurable ball bat.

Still another aspect of the present invention includes a method of making a reconfigurable ball bat including the steps of connecting an end cap to a distal end of the barrel, connecting a transition piece to a proximal end of the barrel, connecting a distal end of a ballast to an engagement structure of the end cap, and connecting a proximal end of the ballast to an engagement structure of the transition piece. These steps form the barrel assembly. Forming the barrel assembly is normally carried out in a factory or manufacturing setting. Another step in the method of making a reconfigurable ball bat includes supporting the barrel assembly on a center tube by inserting the center tube through the transition piece, the ballast, and the end cap. This step can be carried out in a factory, store, or by an end user.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a reconfigurable bat. Throughout the remainder of the description, the bats of each of the embodiments are described with the end of the bat that is normally held by the user during play defined as the proximal end, and the end closer to where the ball normally strikes the bat defined as the distal end.

Figure 1:
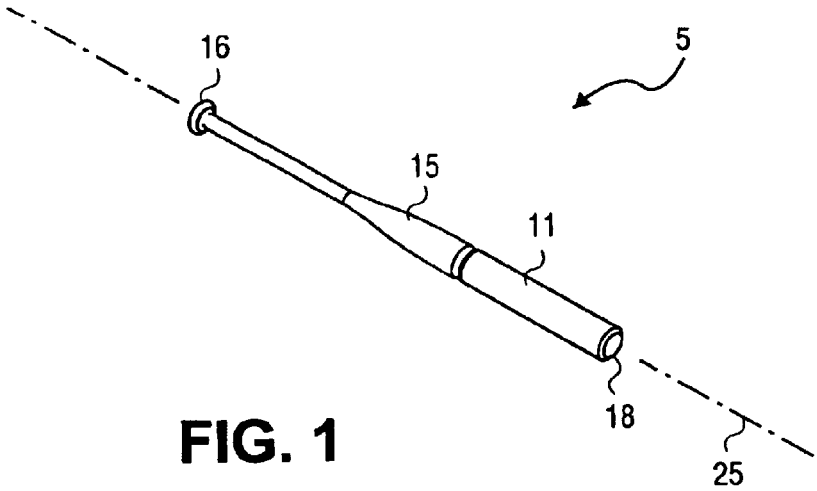
FIG. 1 is a perspective view of a bat in accordance with a first embodiment of the invention comprising an integral handle and transition section and an attached barrel section.
Figure 2:
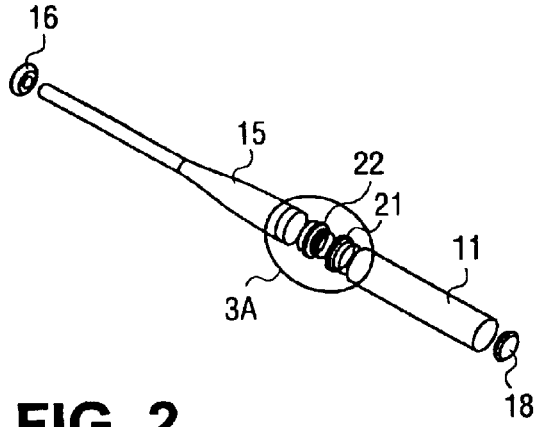
FIG. 2 is an exploded perspective view of the bat of FIG. 1.

FIG. 1 is a perspective view of a first embodiment of a bat 5 with a removable barrel 11 consisting of an integral handle and transition 15 and a barrel 11 joined together with a pair of threaded fittings (21 and 22) as shown in the exploded view of FIG. 2. The bat 5 is closed on a proximal end with a knob 16 and on the distal end with a solid end cap 18. The bat 5 is a hollow bat that behaves similarly to existing aluminum and composite bats with the exception that the barrel 11 may be separated from the integral handle and transition 15 simply by unscrewing one from the other. The knob 16 is permanently attached to the integral handle and transition 15. This can be achieved either by welding or gluing. Alternatively, the knob 16 is integrally molded with the handle 14 during manufacture. Similarly, the solid end cap 18, can be permanently attached to the barrel 11.

The barrel 11 is comprised of a hollow cylinder fabricated from metal such as aluminum or fiber reinforced composites such as graphite fiber, fiberglass or aramid fibers in a polymer matrix such as epoxy, thermoset, or thermoplastic resins. It may also be fabricated from wood if a lower performance bat is desired. The barrel 11 ranges in length from about 7 inches to about 14 inches and ranges in thickness from about 1/20 inch to about 1/4 inch, depending on the material of construction. The diameter of the barrel 11 may be of any size, but typically will range in size from about 2 1/4 inches to about 2 3/4 inches. The ends of the barrel are normal to a central axis 25. On one end of the barrel 11, an aluminum threaded sleeve 21 is attached via adhesive bonding and/or rivets to firmly secure the sleeve 21 to the barrel 11. The sleeve 21 is preferably a threaded female fitting. To the other end of the barrel 11, a solid end cap 18 is attached via adhesive bonding to firmly secure these two pieces together.

The integral handle and transition 15 is a hollow section made from aluminum or fiber reinforced composites such as graphite fiber, fiberglass or aramid fibers in a polymer matrix such as epoxy, thermoset, or thermoplastic resins. To a distal end of the integral handle and transition 15, as shown in FIG. 2, an aluminum male threaded flange fitting 22 is attached via welding or adhesive bonding and/or rivets to firmly secure the flange fitting 22 to the handle and transition piece 15. To the opposite end of the integral handle and transition 15, a knob 16 is mechanically attached via welding or a pinned and adhesive joint. Alternatively, the knob 16 can be co-molded with the handle and transition 15 if it is made from plastics or composites. In any case, the barrel 11, the sleeve 21, and the end cap 18 form a barrel assembly of a first permanently joined group of parts. Similarly, the handle and transition 15, the knob 16, and the flange fitting 22 form an integral handle and transition assembly of a second permanently joined group of parts.

The resulting two-piece bat 5 functions similarly to existing one-piece bats until such time as the barrel 11 is damaged or the batter chooses to replace it by changing the barrel 11 to a barrel of differing performance characteristics better suited to the current game. At that time, a barrel assembly is unscrewed from an integral handle and transition assembly and a new barrel assembly is screwed into place.

Figure 3A:
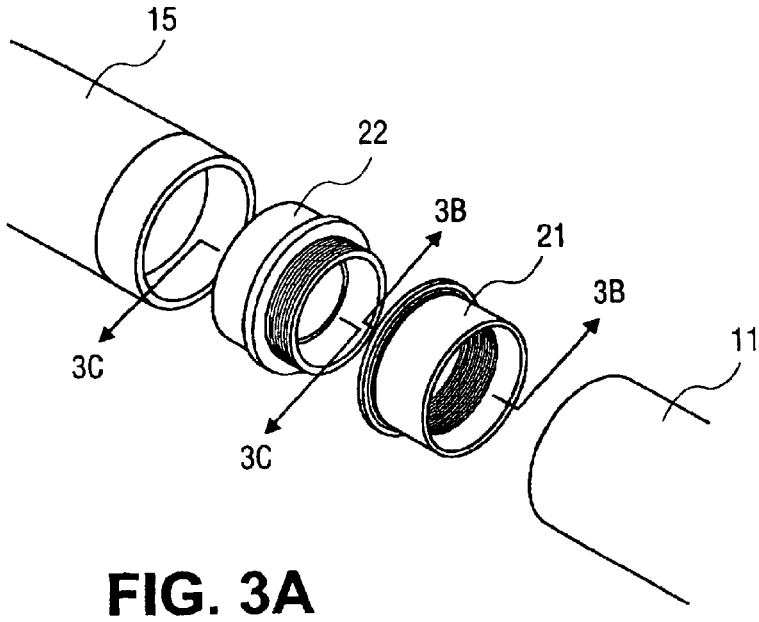
FIG. 3A is an exploded perspective view of a region 3A of FIG. 2 showing a pair of fittings used to connect the bat handle and barrel of FIGS. 1 and 2.

FIG. 3A is a more detailed exploded perspective view of a region 3A of FIG. 2. The fittings 21, 22 and respective portions of the bat 5 to which the fittings 21, 22 are connected are shown. In this figure the geometry of the threaded fittings 21, 22 is better shown. These drawings depict representative configurations for both parts and are not meant to be restrictive so long as the function of joining the two principle sections of the bat is maintained. Also shown more clearly are the surfaces which may be bonded or otherwise attached to the inside diameters of the integral handle and transition 15 and the barrel 11.

Figure 3B:
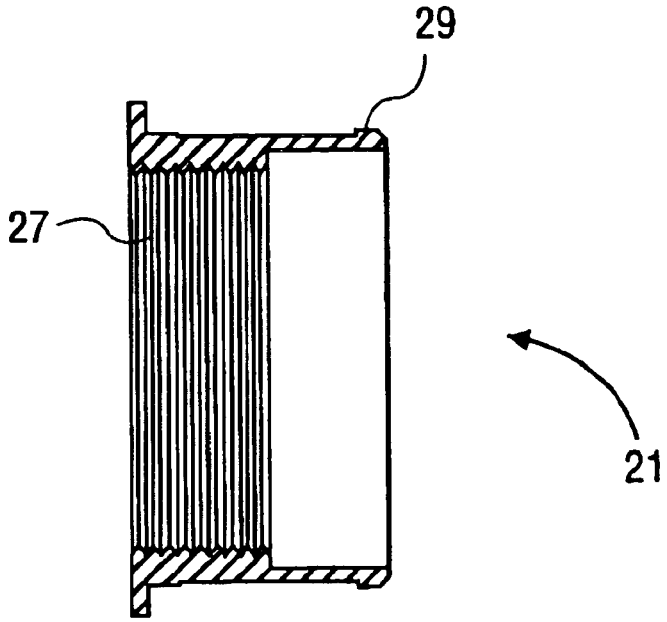
FIG. 3B is a sectional view taken along lines 3B—3B of FIG. 3A.
Figure 3C:
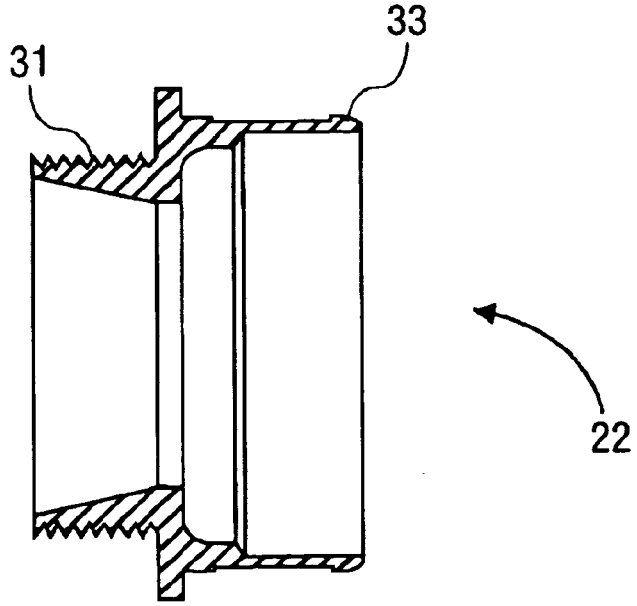
FIG. 3C is a sectional view taken along lines 3C—3C of FIG. 3A.

FIGS. 3B and 3C are sectional views taken along lines 3B—3B and 3C—3C of FIG. 3A respectively. The sleeve fitting 21 has female threads 27 and a radially protruding rib 29 extending outwardly from a sleeve portion of the fitting 21 as shown in FIG. 3B. The male threaded fitting 22 has male threads 31 and a radially extending rib 33 extending outwardly from a sleeve portion of the fitting 22. The radially extending ribs 29, 33 can provide a snap lock attachment to the handle and transition 15 and to the barrel section 11 to compliment rivets or adhesives.

Figure 4:
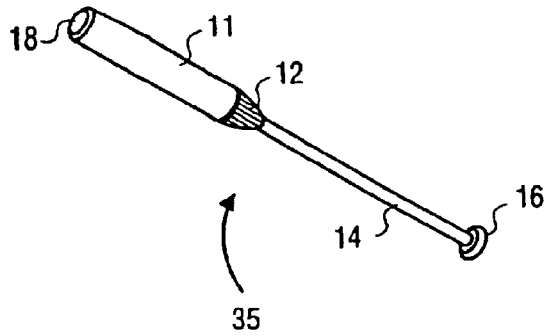
FIG. 4 is a perspective view of a bat in accordance with a second embodiment of the invention comprising a central tube or handle, a mounted transition section, and an attached barrel section.

FIG. 4 is a perspective view of a second embodiment of a bat 35 utilizing the barrel 11 described in the embodiment of FIGS. 1–3C above. The bat 35 includes a center tube or handle 14 and a transition 12 that are different from those provided by the integral handle and transition 15. The bat 35 also includes the threaded sleeve 21, the barrel 11, the solid end cap 18, and the knob 16 similar to those described above. In this embodiment the transition 12 includes an integral male threaded flange 37 that mates with the threaded sleeve 21 to form the joint between handle 14 and barrel 11. This joint allows the barrel 11 to be easily removed and replaced by the owner. As in the previous embodiment shown in FIGS. 1–3C, the knob 16 and solid end cap 18 are permanently attached to the handle 14 and the barrel 11 respectively.

The handle 14 is preferably a hollow tube made from a metal such as aluminum or a fiber reinforced composite material such as graphite, fiberglass or aramid fibers in an epoxy, thermoset, or thermoplastic matrix. The handle 14 could alternatively be solid and formed of the above stated materials or wood. The thickness of the hollow version of handle 14 ranges from about 1/20 inch to 1/4 inch, depending upon the type of material and the allowable weight and depending upon the structural loads to be encountered during play. The outside diameter of the handle 14 ranges from about 3/4 inch to about 9/10 inch. The length of the handle 14 depends upon the chosen length of the barrel 11, knob 16, solid end cap 18, and the overall length of the bat selected. The transition 12 fitting is attached by welding or adhesive bonding and/or rivets to a distal end of the handle 14 in order to firmly secure the transition 12 to the handle 14. To the opposite end of the handle 14, the knob 16 is mechanically attached via welding or a pinned and adhesive joint. Alternatively, the knob 16 can be co-molded with the handle 14 if the handle 14 is made from plastics or composites.

Figure 5:
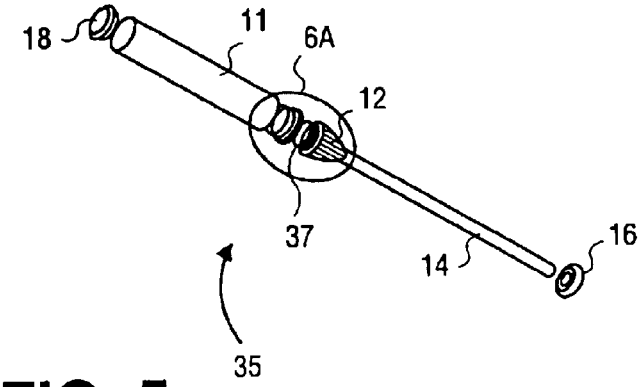
FIG. 5 is an exploded perspective view of the bat of FIG. 4.

FIG. 5 is a perspective exploded view of the bat shown in FIG. 4. FIG. 5 shows the relative locations of the fitting and threaded flange various elements more clearly.

Figure 6A:
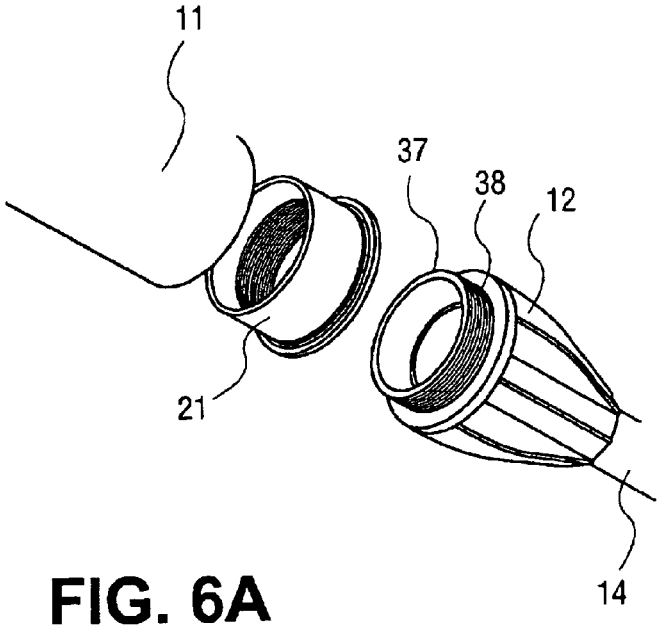
FIG. 6A is an more detailed exploded perspective view of a set of fittings used to connect the barrel and the handle of the bat of FIGS. 4 and 5.

FIG. 6A is a more detailed exploded perspective view of region 6A of the bat 35 shown in FIG. 5. In this figure the geometry of the threaded sleeve 21 and the transition 12 are shown. These drawings depict representative configurations for both parts and are not meant to be restrictive so long as the function of joining the two principle sections of the bat is maintained. Also shown more clearly are the surfaces which may be bonded or otherwise attached together to join the inside diameter of the barrel 11 and the outside diameter of the threaded sleeve 21. As can be appreciated, the threaded sleeve 21 is configured to receive a larger diameter end of the transition 12.

The transition 12 is configured to increase the outer diameter of the bat from the diameter used to make the handle 14 to the diameter of the barrel 11. The length of the transition 12 section is variable, based on a desired weight and appearance. The transition 12 can be fabricated completely or in part from metal such as aluminum so that integral threads 38 are provided with good load transfer capability as can be appreciated from FIG. 6A.

Figure 6B:
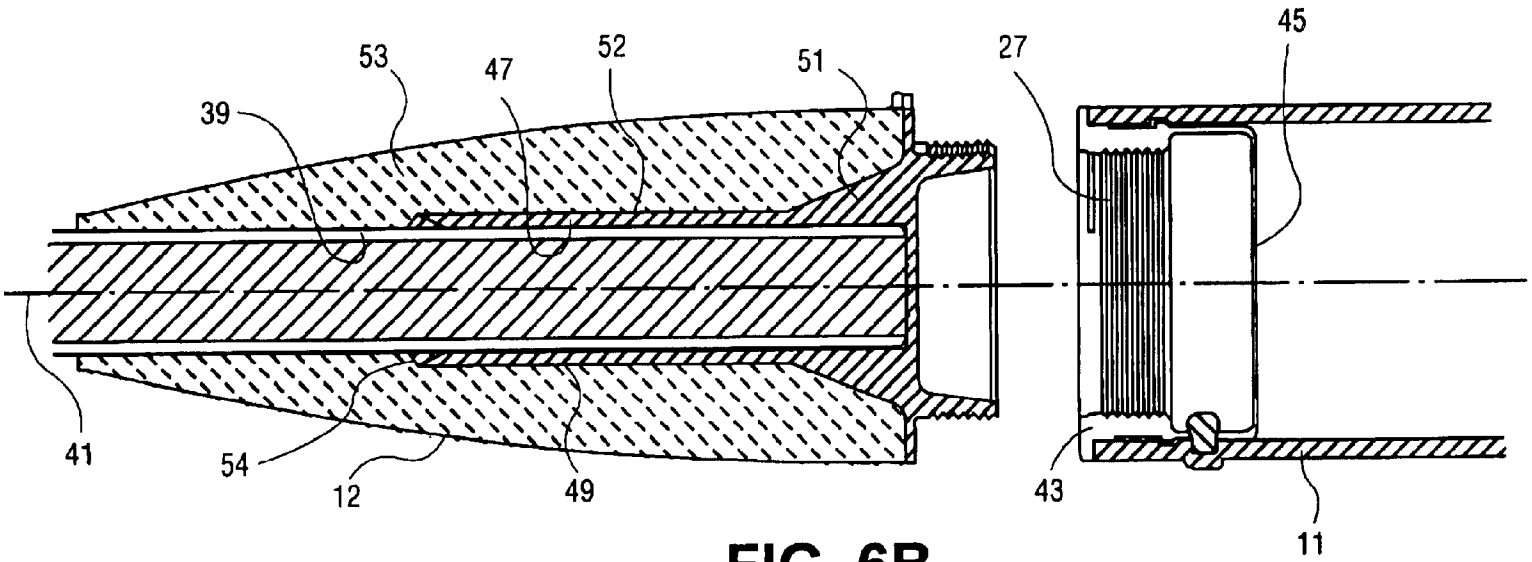
FIG. 6B is a sectional side view of the variation of the fittings of FIG. 6A in a partially assembled state.

FIG. 6B is a sectional view of the same region of the bat 35 as shown in FIG. 6A with an alternative threaded sleeve 43 installed in the barrel 11. The alternative threaded sleeve 43 has a web 45 that spans the barrel in a radial direction and acts as a tamper resistant seal. The web 45 is preferably a thin film in the range from approximately 1/100 to approximately 3/100 inch. (That is, in the range from approximately 10 to 30 thousandths of an inch in thickness.) This web or film 45 forms a seal that provides a way of detecting whether an interior of the barrel has been accessed for illegal machining or material removal. If, during inspection, the seal is found to be broken, then the bat would be suspect.

In the transition itself, a hole defining an inner surface 39 having a first diameter extending along a central axis 41 of the transition 12 is sized to closely fit to the handle 14 as shown in FIG. 6B. If the handle 14 is made from similar material as the transition 12, e.g., aluminum, the transition 12 can be welded to the handle 14 at a proximal end of the transition 12. If the handle 14 is made from composites, the transition can be bonded with an adhesive and/or pinned to the handle 14 to form a good structural joint.

A small step increase in the diameter of the handle 14 and a corresponding step increase in the diameter of the inner surface 39 of the transition 12 to a second diameter 47, which is larger than the first diameter 39, is incorporated into the bat 35 in order to positively prevent the transition 12 from sliding distally toward the barrel 11 when the bat is swung. As indicated by a line 49, this step in diameter can be accomplished by a male threaded flange piece 51 that has an integral sleeve 52 that forms the step and has a diameter that matches the second diameter 47. During manufacture, the threaded male flange piece 51 can be mounted to the handle 14 prior to the remainder 53 of the transition 12. To facilitate mounting and adhering the flange piece 51 to the handle 14, the sleeve 52 is provided with a chamfer 54. This chamfer aids in receiving and spreading an adhesive between the sleeve 52 and the handle 14. The male threaded flange piece 51 actually forms part of the transition 12 and is preferably formed of a metal such as aluminum. The remainder 53 of the transition could be made integral with the sleeve 52 and formed from metal, but doing so is generally cost prohibitive. Thus, the remainder 53 of the transition 12 is preferably formed of a plastic or composite material having a sleeve of its own that surrounds sleeve 52. As such, the remainder 53 of the transition 12 can be slid over a proximal end of the handle 14 to surround and abut the male threaded flange piece 51 during assembly.

Figure 7A:
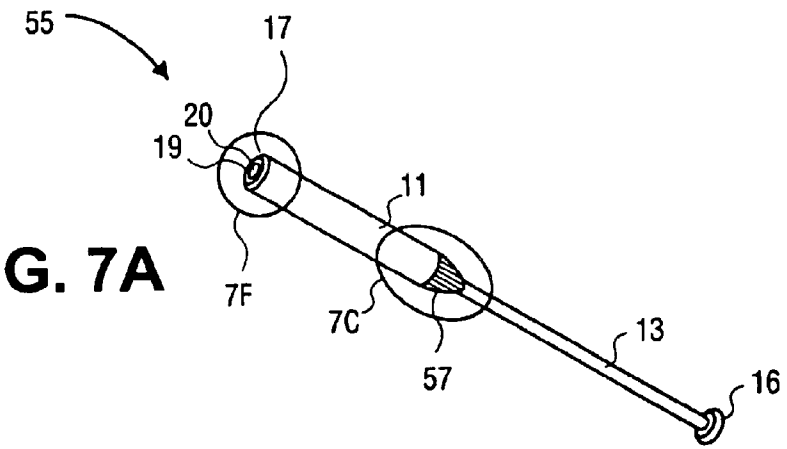
FIG. 7A is a perspective view of a bat in accordance with a third embodiment of the invention comprising a long central tube, an attached transition section and a barrel clamped between the transition section and a hollow end cap.

FIG. 7A is a perspective view of the third embodiment of a reconfigurable bat 55 with a removable barrel 11 and a knob 16 similar to the barrels and knobs described for the embodiments of FIGS. 1–6B above. The bat 55 also has structurally different parts including a central tube 13, a transition 57, a hollow end cap 17, a threaded plug 20, and a nut 19. In this embodiment the joint between the transition 57 and the barrel 11 is unthreaded. Furthermore, the joint between the barrel 11 and the hollow end cap 17 is not permanent. The joining of the various parts of the bat in this embodiment is accomplished by assembling all of the components onto the central tube 13, including a nut 19 which screws onto the threaded plug 20 to secure the assembly together.

The central tube 13 is a structural element made from a metal such as aluminum, a fiber reinforced composite materials such as graphite, fiberglass or aramid fibers in an epoxy, thermoset, or thermoplastic matrix similar to the central tube or handle 14 described with regard to the embodiment of FIGS. 4–6B above only longer. In fact, the central tube 13 extends substantially completely through the barrel to the distal end of the bat 55. The length of the central tube 13 depends primarily upon the overall length of the bat selected, with small adjustments in its length made for the length of the threaded plug 20 and the knob 16. The central tube 13 could also be provided as a solid rod of the same or other materials, including wood.

Approximately midway along the central tube 13, a transition 57 can be removably attached. Alternatively, the transition 57 can be attached via welding or adhesive bonding and/or rivets to firmly secure the transition 57 to the central tube 13. To the proximal end of the central tube 13, the knob 16 is mechanically attached as set forth in the description of the other embodiments above. To the distal end of the central tube 13 is welded or bonded and/or pinned a threaded plug 20 as can be appreciated from the exploded perspective view of FIG. 7B.

Figure 7B:
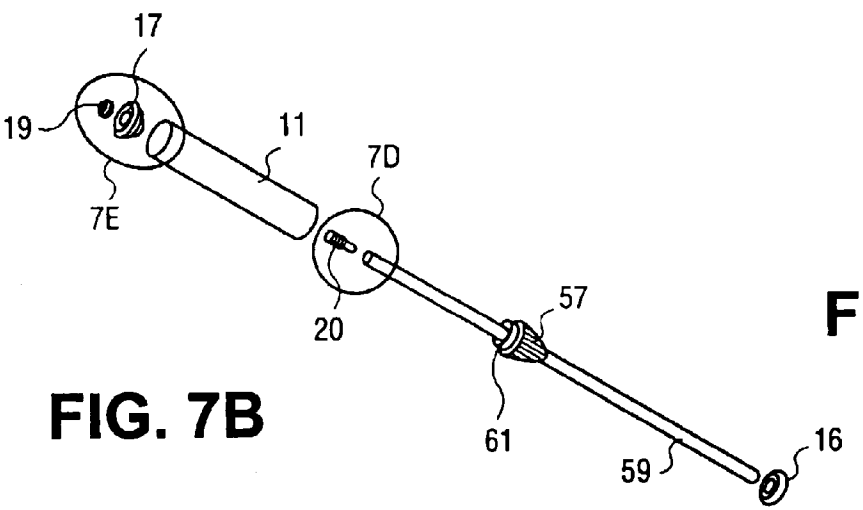
FIG. 7B is an exploded perspective view of the bat of FIG. 7A.

FIG. 7B better shows the various components of the bat in their relative assembly positions. Specifically, FIG. 7B shows the threaded plug 20, the nut 19, the hollow end cap 17, and the central location of the transition 57. The threaded plug 20 is for clamping the end cap 17 onto the end of the barrel 11 to hold the barrel against the transition in an assembled position.

As in the previously described embodiments, the transition 57 is configured to increase the outer diameter of the bat from that of the central tube 13 including a handle portion 59 to the diameter of the barrel 11. The length of the transition 57 is variable, based on desired weight and appearance. In this embodiment, the transition 57 may be fabricated from metal such as aluminum, an injection molded engineering thermoplastic, thermoset material, or other material since integral threads are not required. The hole through the transition 57, along the central axis of the transition 57, is sized to closely fit to the center tube 13. Preferably the transition 57 is removably mounted on the center tube 13 so that the transitions 57 of different configurations can be used. However, if the center tube 13 and the transition 57 are both made from the same metal, e.g., aluminum, the two can be welded together at a proximal end of the transition 57. If the center tube 13 is made from composites, the two may be bonded together with an adhesive and/or pinned together to form a good structural joint.

In the embodiments of FIGS. 7A–8B, a smooth flange 61 of the transition 57 mates with the barrel 11. The smooth flange 61 is not threaded, but presents a smooth surface which slides into and supports the barrel 11 as shown in FIGS. 7B and 7C. The flange 61 itself is slightly recessed radially from an outermost surface 62 of the transition 57. This recess allows an end of the barrel 11 to squarely mate with a surface 63 of the transition 57 extending radially outwardly from the flange 61 at the joint between the flange 61 and the remainder of the body of the transition 57. The radially extending surface 63 is normal to a central axis 65 extending along the length of the central tube 13.

Figure 7C:
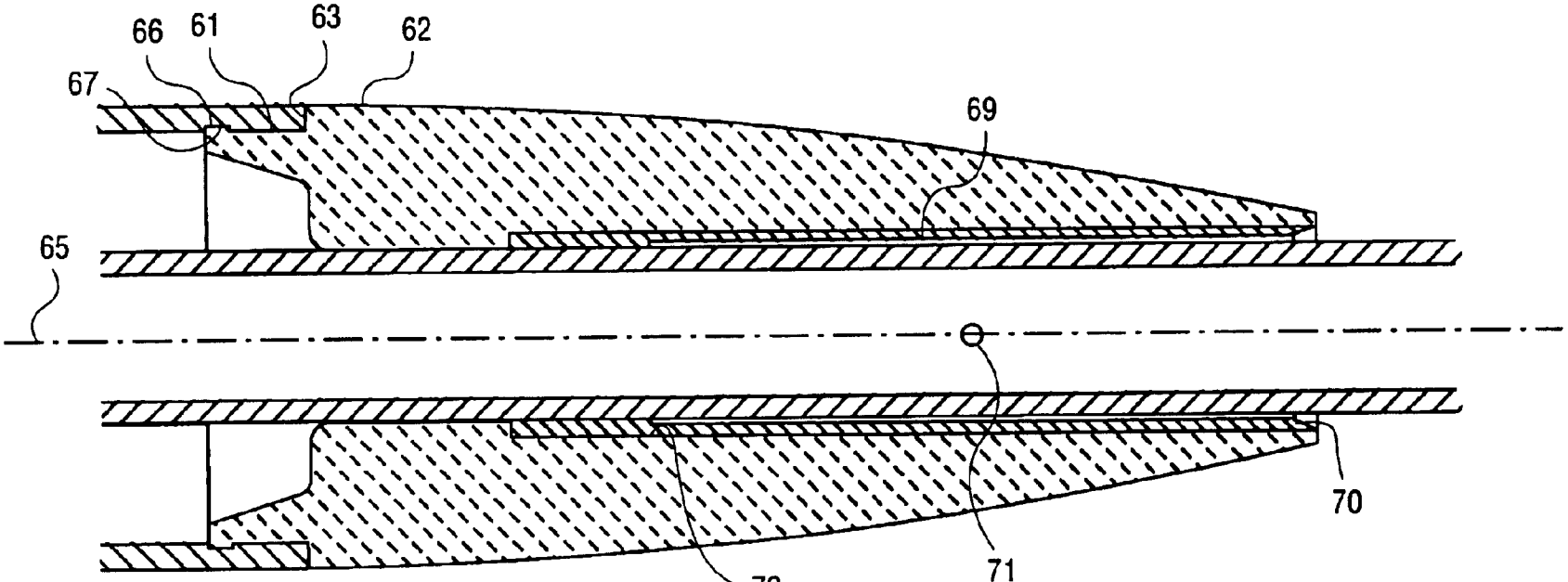
FIG. 7C is a sectional side view of a transition piece and barrel interface of the bat of FIG. 7A.

FIG. 7C is a sectional side view of the bat 55 of FIG. 7A showing how the barrel 11 and transition 57 fit together. As shown, an inner surface of the barrel 11 can be provided with an annular depression 66 and the smooth flange 61 can be provided with a corresponding annular protrusion 67 for snap-fitting into the depression 66.

In the embodiments of FIGS. 7A–8B, a small step change in the diameter of the central tube 13 and a corresponding diameter change in the central hole of the transition 57 may be included in the structure as best shown in the cross sectional view of FIG. 7C. This step change in the outer diameter of the central tube 13 is provided by adding a wrap or sleeve 69 to the central tube 13. The wrap or sleeve 69 is permanently bonded to the central tube 13. The wrap 69 can be adhesively bonded to the center tube 13. This may be accomplished by a separate adhesive material applied between the wrap and the center tube 13. Alternatively, adhesive bonding may be provided by the nature of the material from which the wrap is formed. That is, the wrap may be formed of a fibrous material that is pre-impregnated with a resin which may also include additional fibrous materials. Such a wrap can be adhered by applying a heat treatment to catalyze a reaction between the fibers and the resinous material. At the same time, the resinous material forms a bond with the center tube 13 and bonds the wrap thereto. The wrap or sleeve material is selected based on its compatibility with the material of the center tube 13 and a relative ease of assembly desired for manufacturing purposes. The sleeve 69 can be an aluminum sleeve that is adhesively bonded to the center tube 13. As described above, a chamfer 70 is provided to aid in receiving and distributing an adhesive between the sleeve 69 and the center tube 57. Additionally or alternatively a retention pin 71 can be used to secure the sleeve 69 to the center tube 57. A step 72 in the inner surface of the transition 57 is formed by providing the inner surface with a larger diameter to match that of the wrap or sleeve 69. The steps in both of the outer diameter of the central tube 13 and the inner surface of the transition 57 are provided to positively prevent the transition from sliding in a proximal direction toward the knob 16 when the nut 19 is tightened onto the threaded plug 20, for example.

Figure 7D:
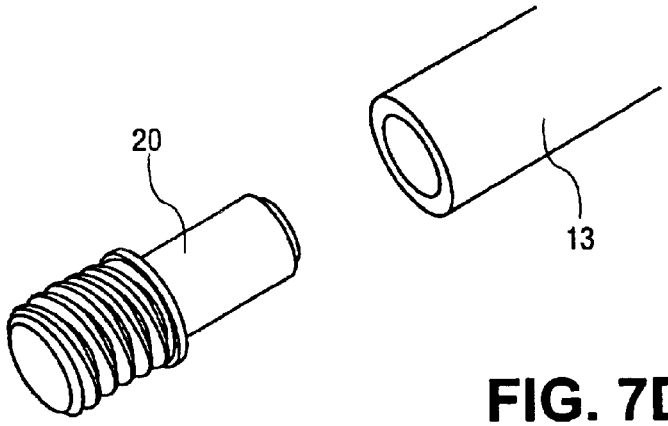
FIG. 7D is an exploded perspective view of a threaded plug fitting and the central tube used in the bat of FIGS. 7A and 7B.

FIG. 7D is a more detailed view of a region 7D of FIG. 7B showing the threaded end plug 20 and the distal end of the center tube 13, which are permanently connected during assembly as described above. In FIG. 7D, the geometry of the threaded plug 20 and the central tube 13 are shown. Also shown more clearly are the surfaces which may be bonded or otherwise attached together to join the inside diameter of the central tube 13 and the smooth outside diameter of the threaded plug 20. This joint provides a structurally stable connection that is able to withstand the tensile forces that are present in the center tube 13 and end plug 20 during the clamping of the barrel 11 on the bat 55 that is regularly present after assembly of the barrel 11 on the bat 55.

Figure 7E:
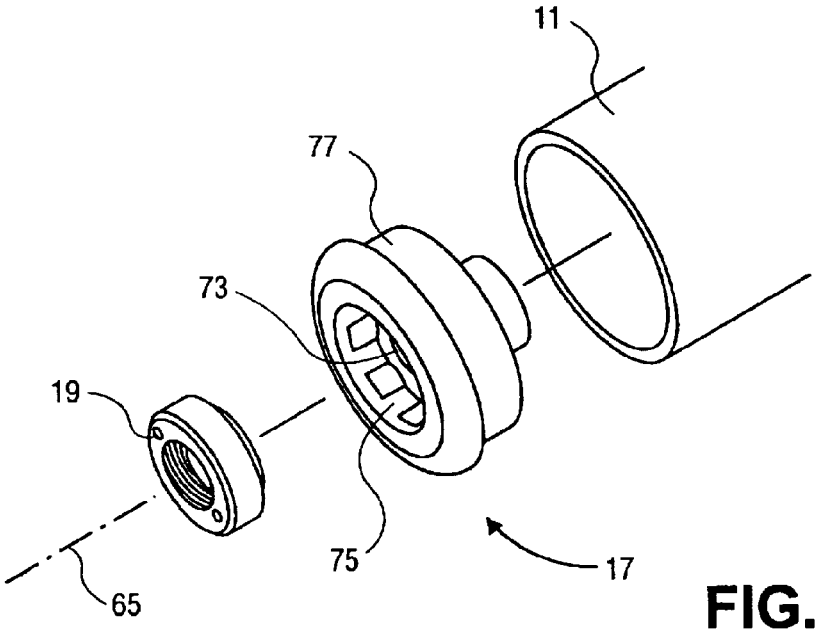
FIG. 7E is an exploded perspective view of a hollow end cap, a nut, and the barrel used in the bat of FIGS. 7A and 7B.

FIG. 7E is a detailed view of a region 7E showing the hollow end cap 17 and the nut 19. In this figure the geometry of the hollow end cap 17 and the nut 19 are shown. Also shown more clearly is the interface between the inside diameter of the barrel 11 and the smooth flange on the hollow end cap 17. The hollow end cap 17, as shown in this embodiment of the invention, incorporates a smooth hole 73 which passes fully through the end cap 17 along the center axis 65 of the bat 55. This allows the threaded plug 20 to pass through and for the nut 19 to be attached to the threaded plug 20 to tighten the assembly together. In another embodiment of the hollow end cap 17, the center hole is threaded so that a separate nut 19 is not required. The hollow end cap 17 itself includes a dome shaped end, a counterbore 75 to the central hole 73 (if a nut 19 is used), and a smooth flange 77 that slides into and supports the barrel 11. As on the transition 57 described above, this flange is slightly recessed to allow the end of the barrel 11 to squarely mate with a surface extending radially from a center of the end cap 17 and being normal to the axis 65 extending down the length of the central tube 13.

Figure 7F:
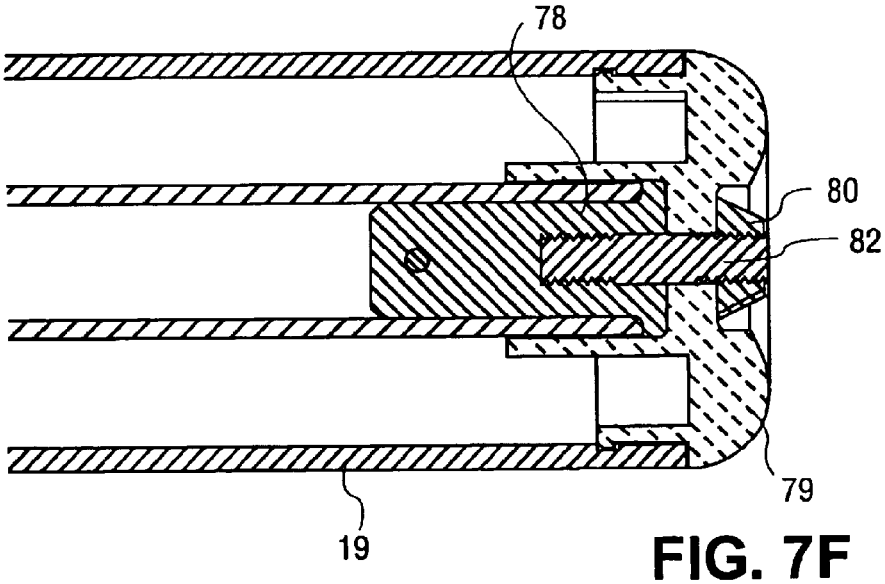
FIG. 7F is a sectional side view of a variation of the end plug, end cap, and nut in accordance with the embodiment of FIGS. 7A and 7B.

FIG. 7F is a sectional side view of an alternative embodiment of a threaded end plug 78, end cap 79, and nut 80. In this embodiment, the threaded portion is provided by a threaded shaft 82 that is inserted in a main body of the plug 78 and extends distally to receive the nut 80. Since the shaft 82 is smaller in diameter than the threaded portion of the threaded end plug 20, the hole through the end cap 79 can be smaller. Furthermore, because the shaft 82 is smaller in diameter than the threaded portion of plug 20, the shaft 82 may be made of a stronger and denser material such as stainless steel without a significant weight impact. Otherwise, the end cap 79, plug 78, and nut 80 assembly is substantially similar to that shown and described with regard to FIGS. 7A–7E above.

Figure 8A:
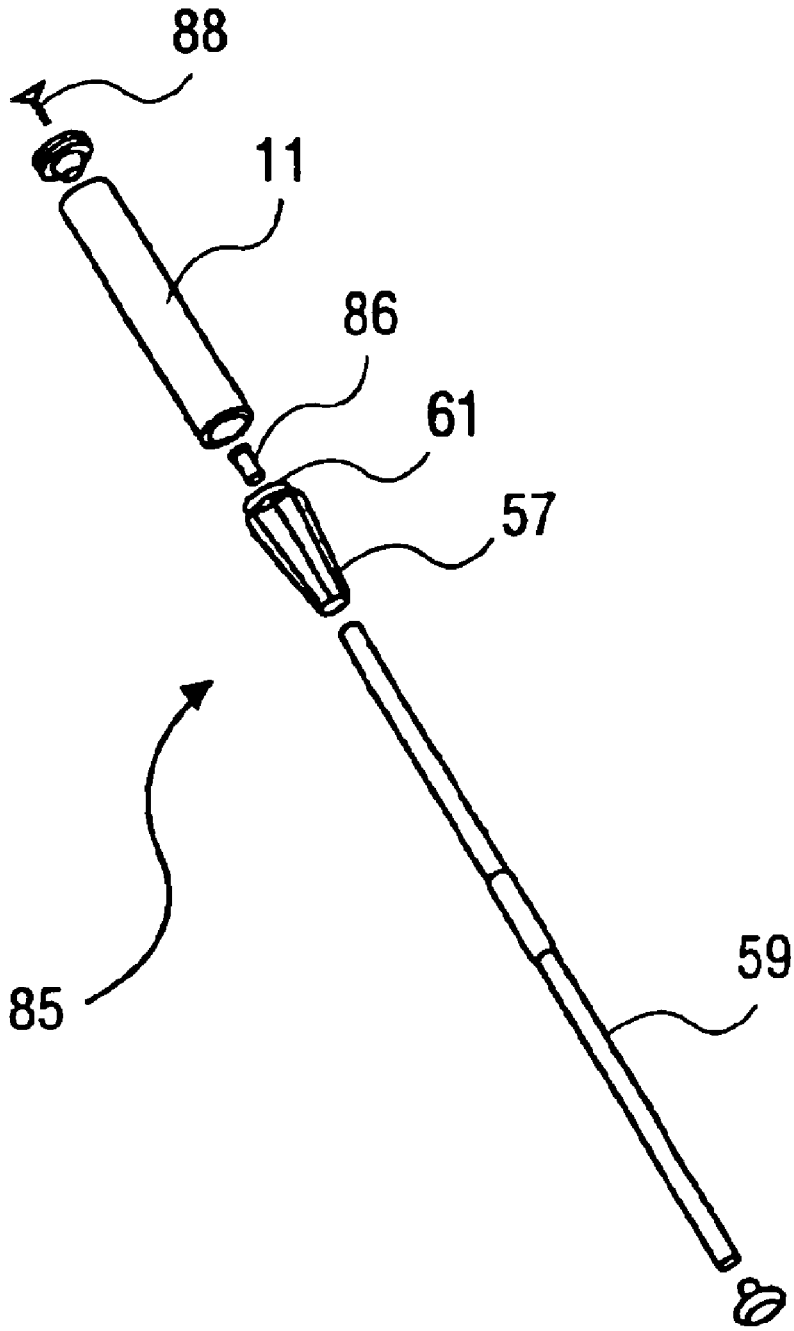
FIG. 8A is an exploded perspective view of a bat in accordance with a fourth embodiment of the invention.

FIG. 8A is an exploded perspective view of a further embodiment of a bat 85 in accordance with the invention similar to the embodiments of FIGS. 7A–7F. However, instead of a threaded end plug 20, 79 and nut 19, 80 to hold the end cap in place, the end plug 20, 79 has been replaced by an end plug 86 having internal threads and the assembly nut 19, 80 has been replaced by a screw 88. The embodiment of FIG. 8A is otherwise substantially similar to that of FIGS. 7A–7F.

Figure 8B:
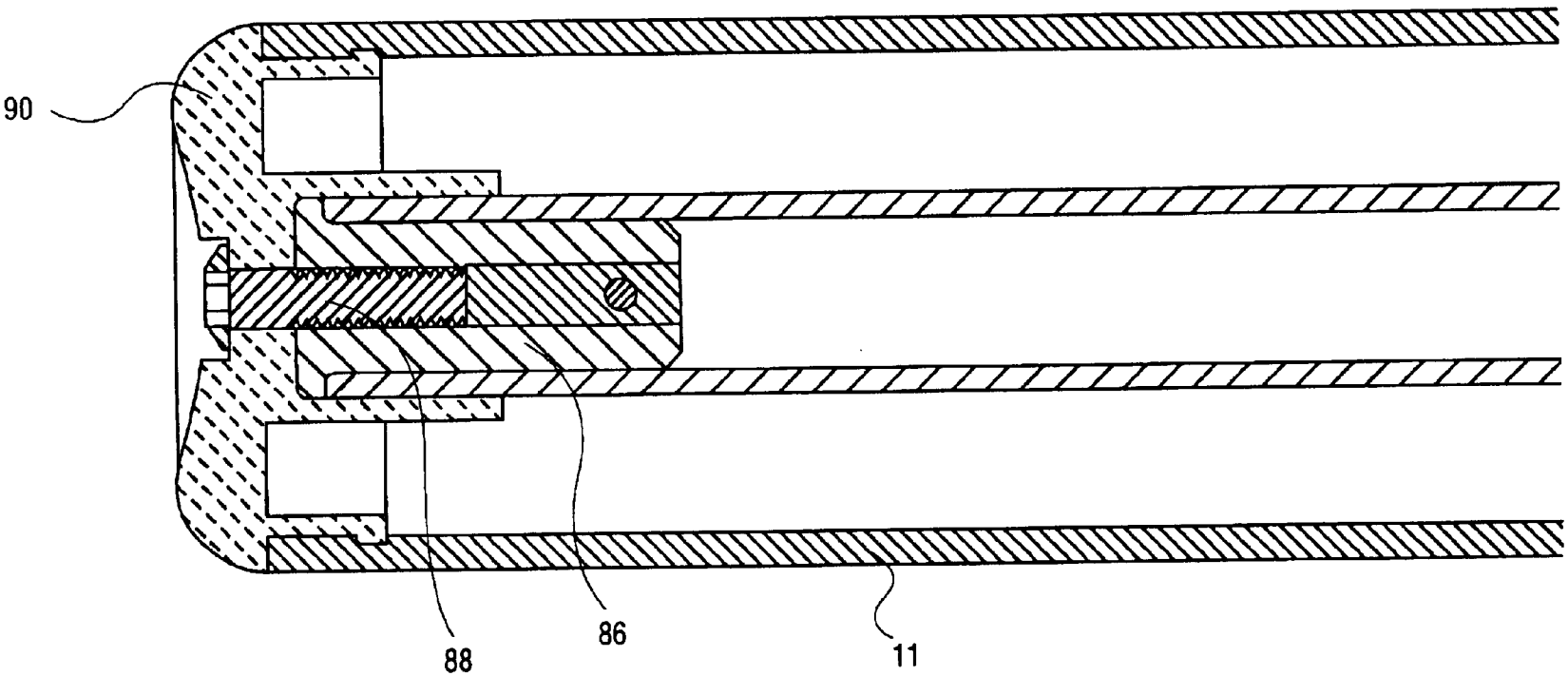
FIG. 8B is a sectional side view of the bat of FIG. 8A showing the configurations of an end plug, an end cap, and a screw in an assembled state.

FIG. 8B is a sectional side view of a portion of the bat 85. The portion of the bat 85 shown in FIG. 8B differs from the embodiments of FIGS. 7A–7F. As shown, the end plug 86 receives the threaded screw 88. The head of the screw 88 holds a modified end cap 90 in place on the end of the center tube 13 and the barrel 11.

It should be noted that each of threaded sleeves or fittings 21, 22, nut 19, 80 or analogous screw 88, threaded end plugs 20, 79, internally threaded end plug 86, end caps 17, 78, 90 and transition pieces 12 and 57 are all couplers. Additional couplers may also be substituted for these elements without departing from the spirit and scope of the invention. However, the configuration of the couplers is considered to be unique and very advantageous.

In all of the embodiments, the couplers are located and configured to spread bending forces over large sections and along great lengths of the bats 5, 35, 55, and 85. In the embodiment of FIGS. 1–6B, this is accomplished by providing the couplings 20, 21, and 51 with bearing surfaces comprising female threads 27 and male threads 31 and 38 as shown in FIGS. 3B, 3C, and 6A. As can be appreciated, the bearing surfaces are at radii that are almost as great as the diameter of the barrel. As such, the sections over which the bending forces are spread during play are much greater than they would be if the bearing surfaces were at smaller radii. Furthermore, the strength of the material distributed at the larger radii is much greater. Still further, the bearing surfaces of the mating couplings 20, 21, and 51 extend a sufficient length in the axial directions to distribute the bending loads along a substantial length of the bats 5 and 35.

In the embodiments of FIGS. 7A–8B the bearing surfaces are relatively smooth surfaces comprising portions of smooth flange 61 and surfaces 63 on transitions 57, and analogous surfaces on each of the end caps 17, 77, and 90. These bearing surfaces abut bearing surfaces of the barrel 11 and apply clamping or compressive forces under the action of the center tube 13, end plugs 20, 79, 86, and the nuts 19, 80 or screw 88. The nuts 19, 80 or screws exert the tensile force when turned in a tightening direction. The nuts 19, 80 can have a hex or other configuration. The screw can incorporate a hex or other shaped depression in the head for conventional or other manipulation. The nuts, 19, 80 and screw 88 may be configured with a security or custom configuration that requires a special tool for tightening or loosening.

The embodiments described in the following pages are generally configured and intended to provide greater weight savings among the various components. This is accomplished in a variety of ways including using lighter weight materials and eliminating elements that are unnecessary. For example, use of epoxy as an adhesive and metals can be replaced by other fixing means and light weight plastics or composites. On the other hand, the principles set forth above are generally applicable to all of the embodiments even though the details are not specifically applied to the various embodiments described below. For example, all of the couplers and the structural manner in which those couplers distribute bending forces and forces of impact are similar for the embodiments described below. Specifically, the end plugs with elongate and disk shaped heads, anti-rotation fittings, set screws, end caps, and transition pieces set forth and described below are all couplers that are analogous and advantageous in similar ways as those described above. However, the configuration of these couplers described below is considered to be unique and very advantageous in additional ways. Just as the teachings of the above described embodiments are applicable to the embodiments set forth below, the teachings of the embodiments below are also applicable to the embodiments set forth above in order to provide any or all of the additional advantages of the embodiments set forth below.

Figure 9A:
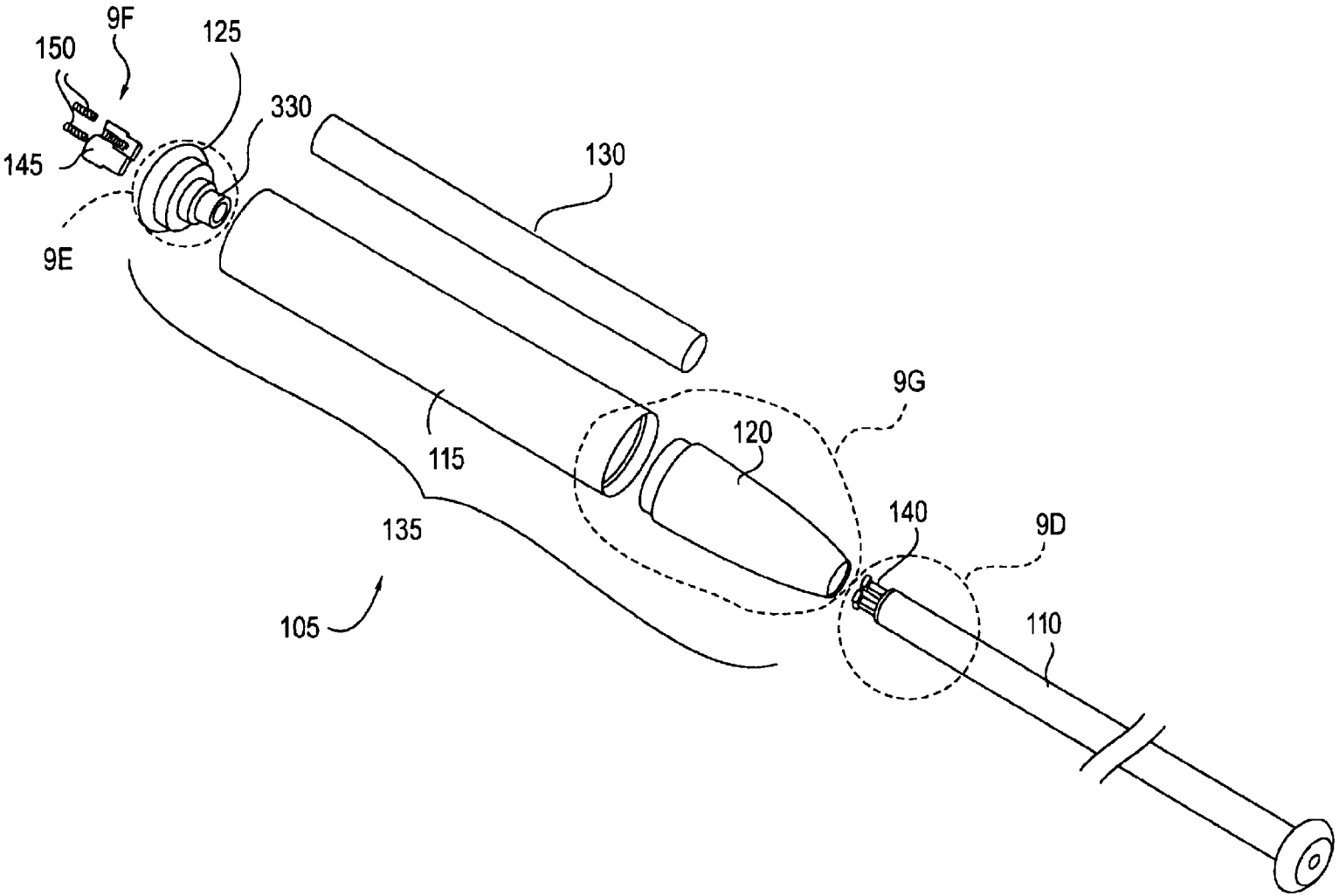
FIG. 9A is a exploded perspective view of a fifth embodiment of the present invention.

As shown in FIG. 9A, a reconfigurable ball bat 105 is shown in an exploded perspective view according to a fifth embodiment of the invention. The bat 105 has a center tube 110 analogous to the center tubes described above and that extends substantially a full length of the bat 105. The barrel section 115 is supported on the center tube 110 by a transition piece 120 and an end cap 125. A weighting ballast 130 is mounted inside the barrel 115 to provide a predetermined amount of weight that is evenly distributed. The barrel 115, the transition piece 120, the end cap 125, and the ballast 130 form a barrel assembly 135 that can be mounted and removed from the center tube 110 as a unit. The cost of the transition 120, end cap 125, and ballast 130 can be kept small, such as for example, by forming them of thermoplastic or thermoset materials as set forth above. Thus, the convenience of installing and/or removing the barrel assembly as a unit easily outweighs the cost of these components when they are discarded with a damaged barrel 115, for example.

Figure 9B:
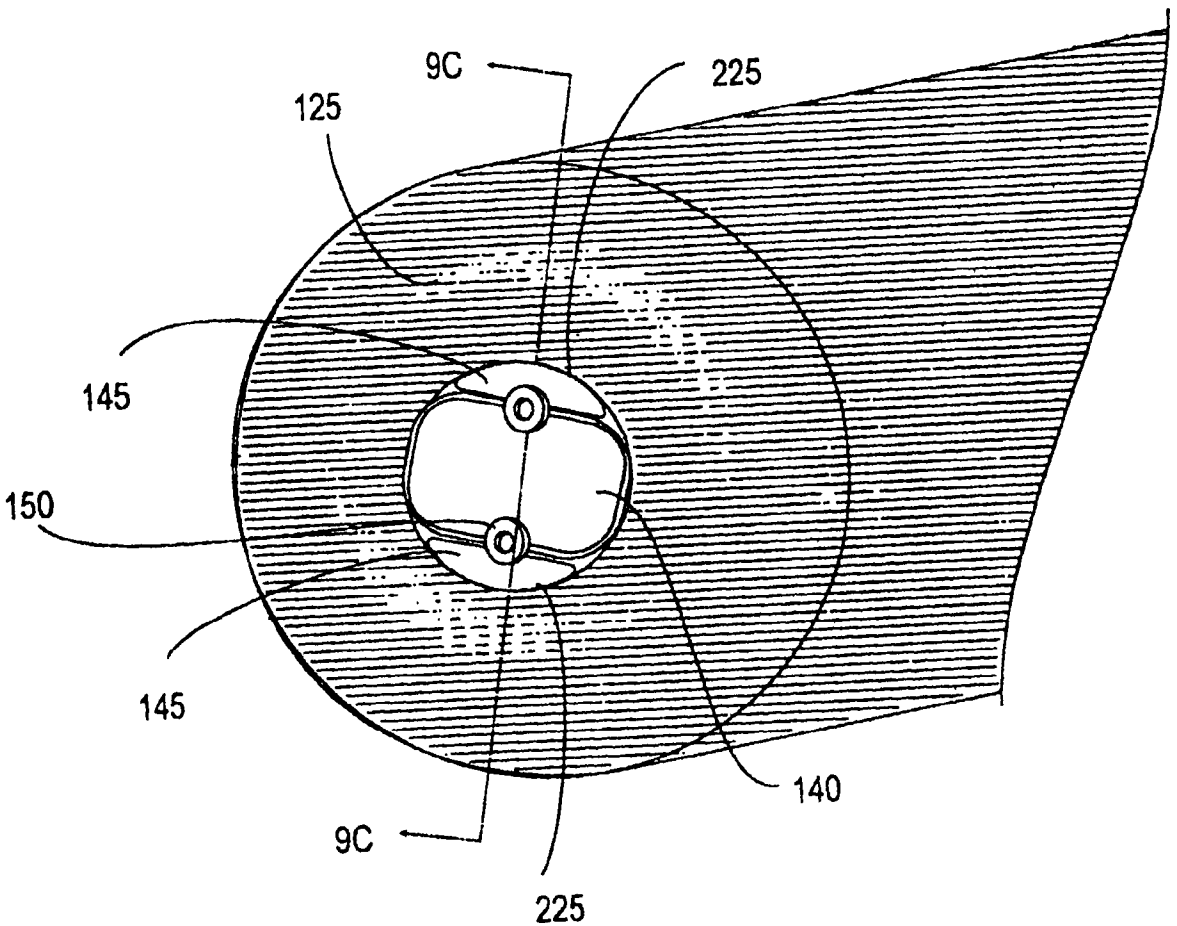
FIG. 9B is perspective view of a butt end of the bat of FIG. 9A with a barrel assembly installed on the bat.
Figure 9C:
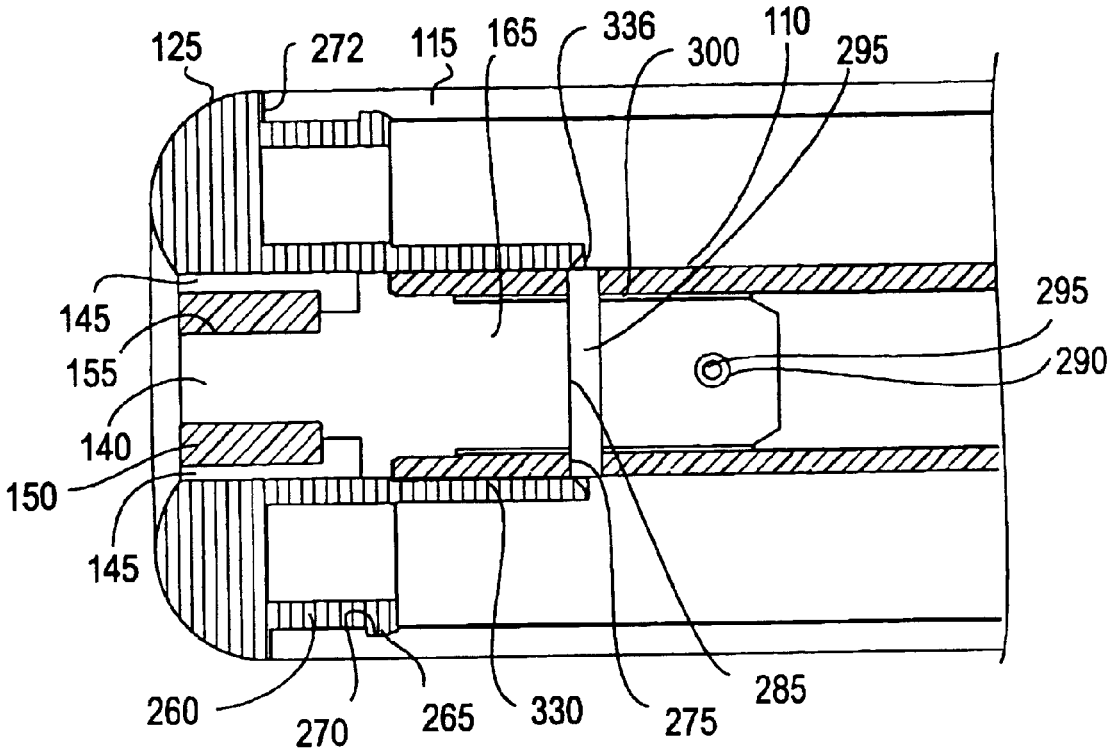
FIG. 9C is a sectional view taken along lines 9C—9C of FIG. 9B.

To mount the barrel assembly 135 on the center tube 110, the center tube 110 is inserted through the barrel assembly 135. An end plug 140 fixed in a distal end of the center tube 110 is rotated together with the center tube 110 to a locking position relative to the end cap 125. Two anti-rotation fittings 145 are then inserted between the end plug 140 and the end cap as shown in FIGS. 9A–9C. Then a pair of set screws 150 are screwed into threaded bores 155 formed between the anti-rotation fittings 145 and the end plug 140.

Figure 9D:
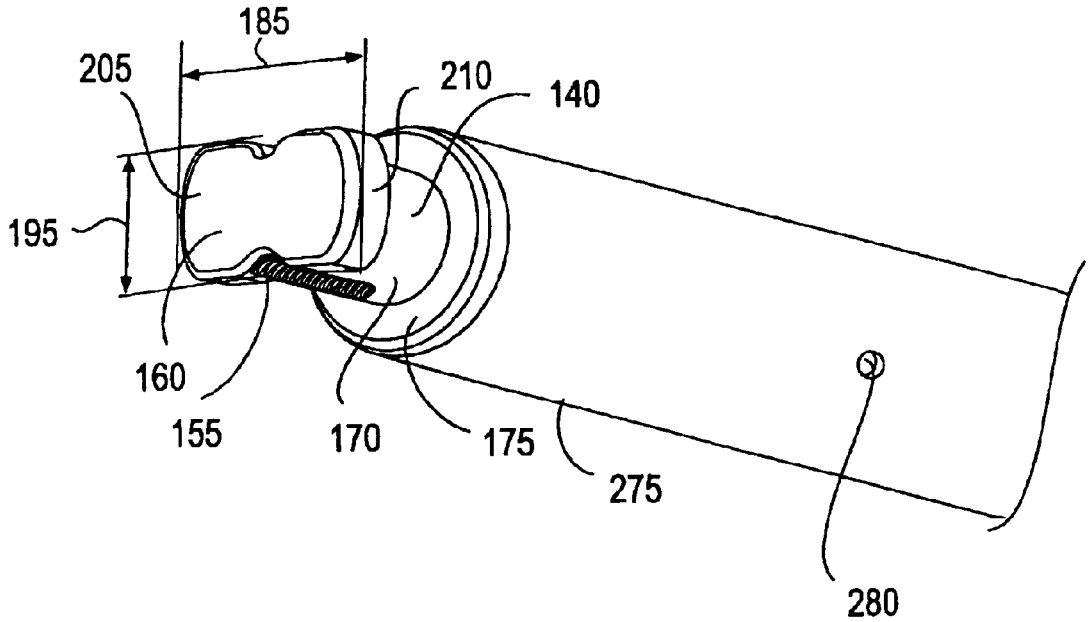
FIG. 9D is a perspective view of the a region 9D of the center tube and end plug encircled in FIG. 9A.
Figure 9E:
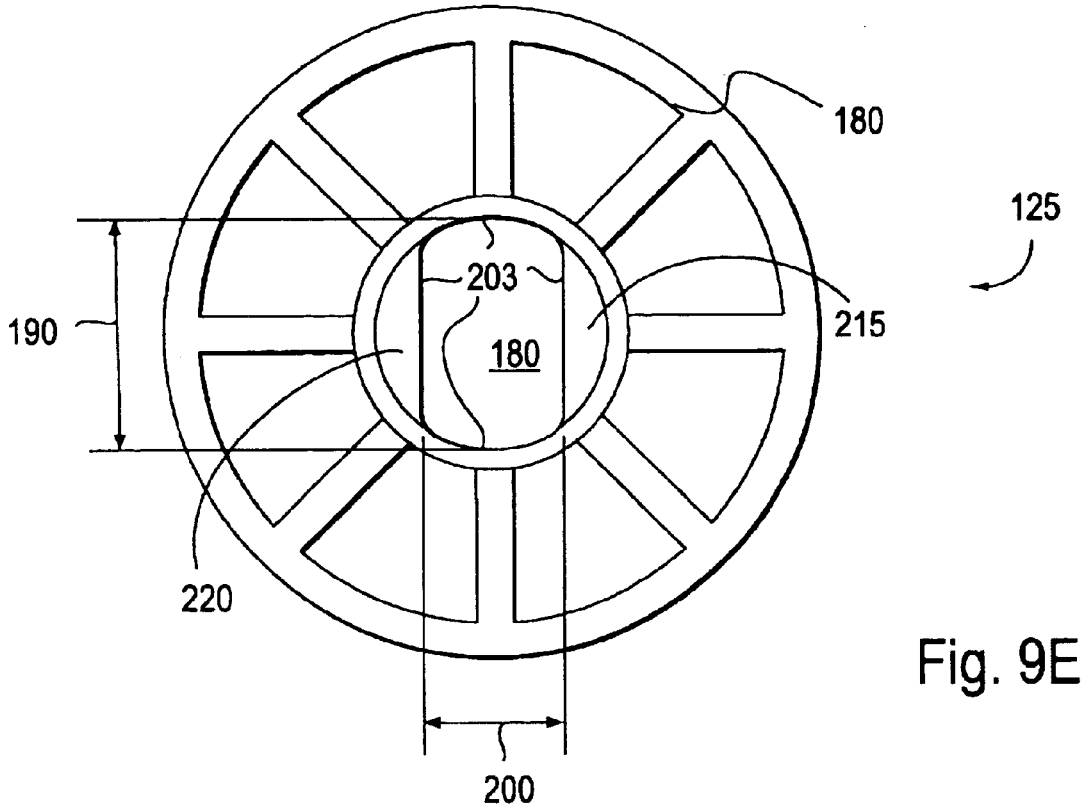
FIG. 9E is a plan view of an interior side of the end cap encircled at 9E in FIG. 9A.

As shown in greater detail in FIG. 9D, the end plug 140 has an elongated head 160 protruding distally from a body 165 that is fixed inside the center tube 110, as shown in FIG. 9C. The elongated head 160 is connected to the body 165 by a neck 170 and a collar 175. The head is inserted into an elongate slot 180 in the end cap 125. The elongated head has a length dimension 185 slightly less than a length dimension 190 of the slot 180, and a width dimension 195 slightly less than a width dimension 200 of the slot 180 of the end cap 125 as can be appreciated from FIG. 9E. Thus, the elongated head 160 can be slid past walls 203 forming the slot 180 in the end cap 125. The neck 170 has a diameter less than the width dimension 200 of the slot 180 so that the center tube 110 and end plug 140 can be rotated with the end plug 140 engaged in the slot 180. To interlock the end plug 140 with the end cap 125, the end plug 140 and center tube are rotated approximately ninety degrees relative to the end cap 125. In this position, the opposite longitudinal ends 205, 210 overlap an exterior facing surface of ledges 215, 220 and form a stop against distal movement of the end cap 125 relative to the end plug 140. The collar 175 can abut interior facing surfaces of the ledges 215, 220 and form a stop inhibiting movement of the end cap 125 in a proximal direction relative to the end plug 140.

Figure 9F:
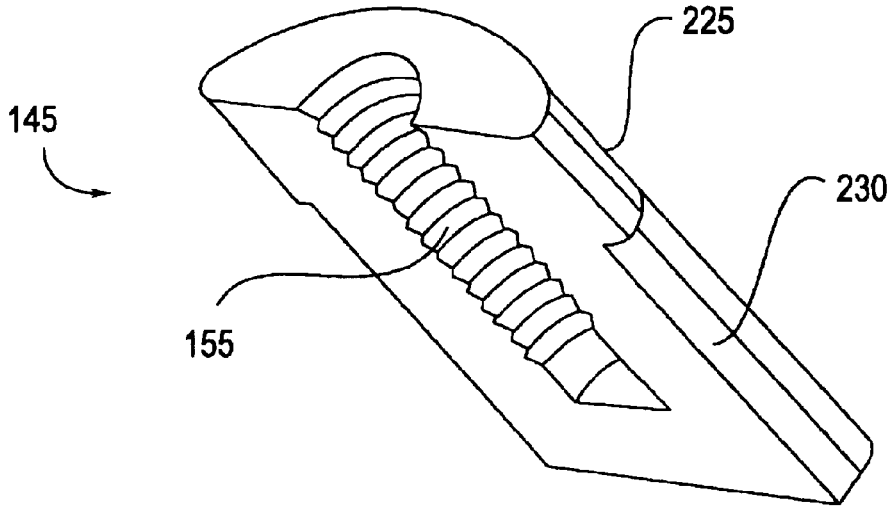
FIG. 9F is an enlarged perspective view of the anti-rotation fitting indicated at 9F in FIG. 9A.

To inhibit rotation of the center tube 110 and the end plug 140 out of the interlocked position, anti-rotation fittings 145 are inserted between the end plug 140 and the end cap 125, as briefly described above. The anti-rotation fittings 145 each have a head portion 225, and a neck portion 230 as shown in FIG. 9F. The neck portions 230 extend proximally beyond the exterior facing surface of ledges 215, 220 in an inserted position. Thus, the neck portion 230 will abut the walls 203 forming the elongate slot 180 and prevent rotation of the center tube 110 and the end plug 140 relative to the end cap 225. At the same time, head portions 225 of the anti-rotation fittings 145 and a distal surface of the elongated head 140 form a generally flat circular surface that is slightly recessed from the most distal portions of the end cap 125, as can be appreciated from FIGS. 9B and 9C. Half of threaded bore 155 is provided in the anti-rotation fitting 145 and half of the threaded bore 155 is provided in the end plug 140 as shown in FIGS. 9C, 9D, and 9F. As briefly described above, set screws 150 are screwed into the threaded bores 155 and secure the anti-rotation fittings against sliding out relative to the end plug 140. As can be appreciated, just one fitting would prevent rotation of the end plug 140 and center tube 110 relative to the end cap 125. However, two anti-rotation fittings 145 and two set screws 150 advantageously provide redundancy. Further redundancy may be accomplished by providing the anti-rotation fittings 145 and/or set screws 150 as wedge shaped so that tightening the screws 150 would further inhibit relative axial and rotational movement between the end plug 140 and the end cap 125. Alternatively, an interlocked state could be accomplished purely with a wedge configuration without the longitudinal ends 205, 210 of the head 160 of the end plug 140 overlapping the exterior surfaces of ledges 215, 220.

Figure 9G:
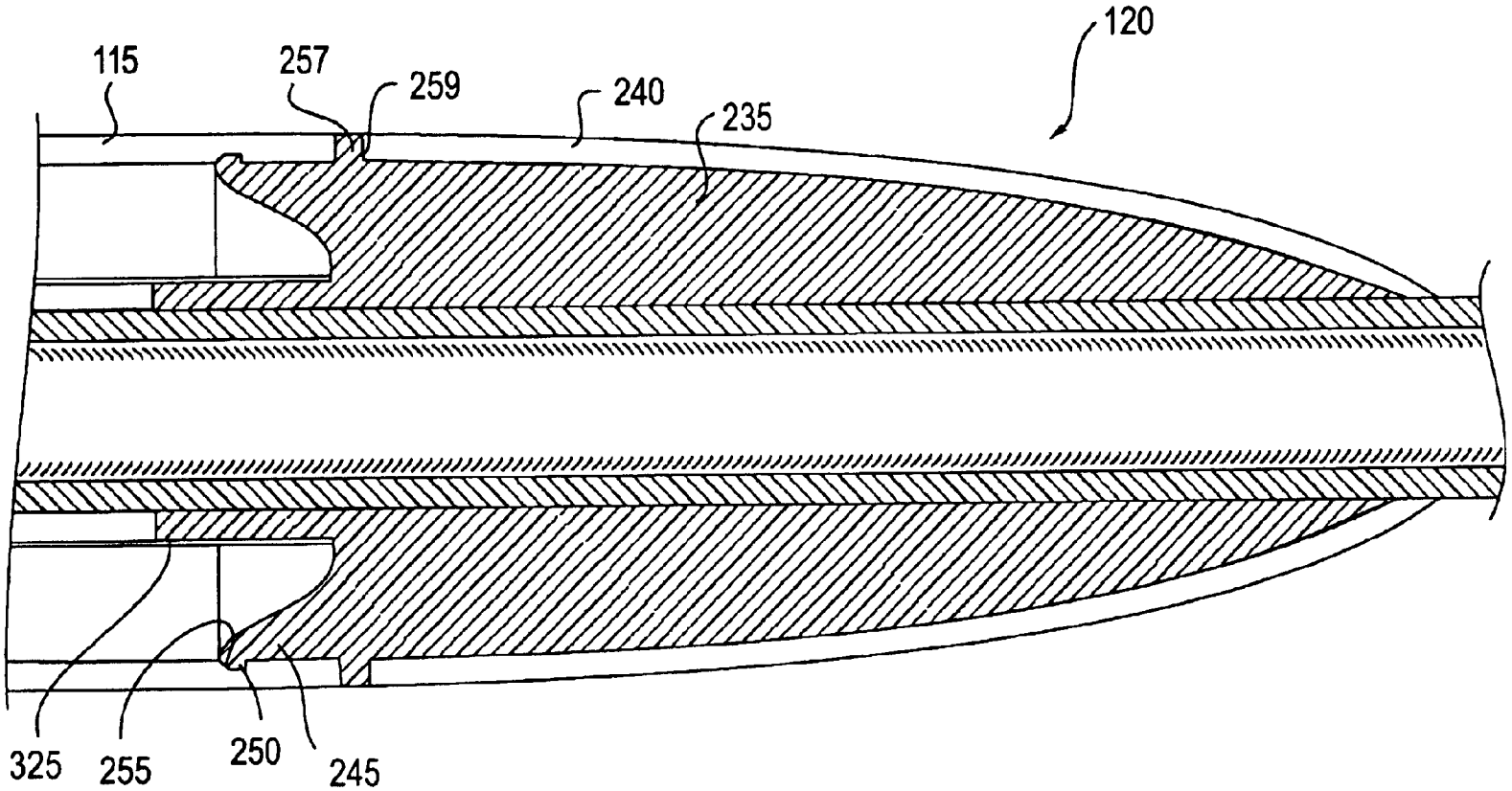
FIG. 9G is sectional view of a region 9G of FIG. 9A.

FIG. 9G is a sectional view of the transition piece 120 shown in region 9G of FIG. 9A. The transition piece includes a core 235 similar to the finned transition pieces of the embodiments shown in the other figures and described above. The transition piece 120 also has a shell 240 that fits over the fins of the core 235 and forms a smooth aesthetic exterior for the transition piece. The shell 240 can be fixed to the core 235 in any number of ways including, but not limited to, a friction fit, a snap lock fit similar to that to be described with regard to FIGS. 10A–10C below, an adhesive bond, and an ultrasonic weld at a proximal face 259 of the flange 257. In any case, the transition piece used with the embodiment of FIGS. 9A–9G has an axially extending flange 245 with a radially outwardly extending protrusion 250. This protrusion 250 enables the transition piece 120 to lockingly fit together with the barrel 115. As shown, an inner surface of the barrel 115 can be provided with an annular depression 255. The protrusion 250 on the axially extending flange 245 lockingly engages the depression 255 and inhibits subsequent proximal movement of the transition piece 120 relative to the barrel section 115. The radially extending flange 257 on the core 235 of the transition piece 120 abuts with a proximal end edge of the barrel section 115 and prevents movement of the transition piece 240 in a distal direction relative to the barrel section 115. Thus, relative axial movement between the barrel 115 and the transition piece 120 is inhibited. It is to be understood that the transition piece 120 can be snap locked to the barrel in this way prior to or during installation of the barrel assembly 135 on the center tube 110.

A similar snap lock configuration is provided between the end cap 125 and the barrel section 115 as shown in FIG. 9C. An axially extending flange 260 is provided on the end cap 125. The axially extending flange 260 has a radially outward extending protrusion 265 that engages an annular depression 270 when the end cap 125 is assembled with the barrel section 115. A radially extending portion 272 on the end cap 125 engages a distal end edge of the barrel section 115. Thus, movement of the barrel section 115 relative to the end cap 125 is substantially prevented in both proximal and distal directions. As with the assembly of the transition piece 120 and the barrel section 115, the assembly of the end cap 125 and the barrel section 115 can be effected prior to or at the time as the installation of the barrel assembly 135 on the center tube 110. It is to be understood that adhesive could be added to any and all of the snap lock connections for added security.

As can be appreciated from FIGS. 9C and 9G, the snap lock of the protrusions 250, 265 with the annular depressions 255, 270 holds the end cap 125, barrel section 115, and transition piece 120 together in a generally permanently assembled configuration. These components together with the ballast 130 that is mounted within the barrel section 115, as will be further described below, form the barrel assembly as a unitary and generally permanent assembly that is installed and/or removed from the center tube 110 as a unit. As such, the components of the barrel assembly 135 are generally fixed relative to each other. The end plug 140 is fixed to the end cap 125 as set forth in the description of FIGS. 9A–9F above. The end plug 140 is fixed in a distal end of the center tube 110 similarly to the end plugs of the previously described embodiments. Therefore, the barrel assembly is also fixed relative to the center tube 110.

Similar to fixing mechanisms shown and explained with regard to previously described embodiments, FIGS. 9C and 9D show through holes 275, 280 in the center tube 110. The end plug has corresponding through holes 285, 290. Pins 295 can be inserted in the corresponding through holes 275, 285 and 280, 290 in their respective aligned positions to fix the end plug 140 in the center tube 110. Additionally or alternatively, an adhesive 300 can be used to bond the end plug 140 to the center tube 110 similar to the adhesive bonds described above. These pins and/or adhesive offer redundancy in fixing the end plug 140 to the end cap 125. This together with the redundancy in interlocking the end cap 125 to the end plug 140, provides an exceedingly secure system that will prevent the barrel assembly 135 from moving along the center tube 110. Of particular interest, the system prevents the barrel assembly or any of its parts from inadvertently leaving the center tube 110 during play.

Figure 9H:
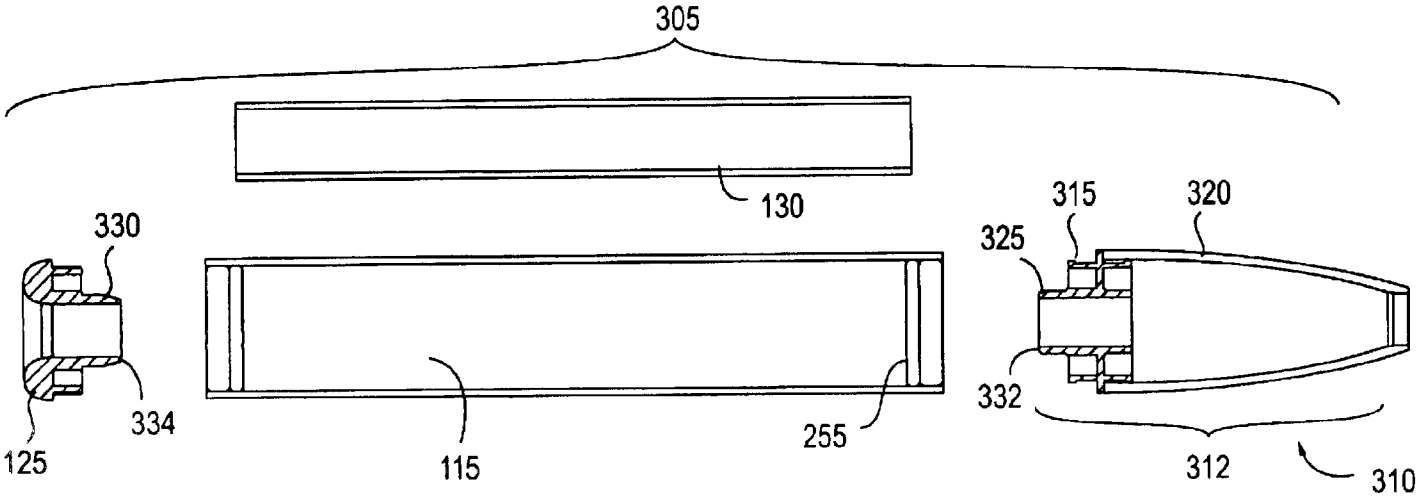
FIG. 9H is an exploded sectional view of a slightly modified barrel assembly without the center tube and fittings.

FIG. 9H shows an exploded sectional view of a barrel assembly 305 incorporating a modified transition piece 310. All the other components of the barrel assembly 305 are substantially the same as those described with regard to FIGS. 9A–9G above. The transition piece 310 is a two-piece transition subassembly 312 including a radially extending short piece 315 and a shell 320 similar to the shell 240 shown in FIG. 9G above.

The ballast 130 is substantially and conceptually the same for all of the embodiments of FIGS. 9A–12B. The ballast 130 can also be applied to many if not all of the embodiments of FIGS. 1–8B. However, the ballast will be described in detail with regard to FIGS. 9H and 91. The ballast tube 130 can be formed of a plastic or a metal tube. In a particular form, the ballast tube 130 is formed of a thin film material such as polyethylene or polypropylene. The ballast tube 130 has very low stiffness and does not add to the structural rigidity of the barrel assembly 305. The ballast tube 130 is particularly beneficial in adding a controlled amount of weight to the barrel assembly. For example, tubes having different wall thicknesses may be provided so that a twelve inch ballast tube may weigh in a range from one to ten ounces. Thus, for example, with the rest of the bat components weighing twenty to twenty-one ounces and the ballast tube weights incremented by one ounce in the range from one to ten ounces, all of the most sought after weights can be selectively provided. Of course, for bats in which the rest of the components weigh more, the versatility in weight adjustment will be limited.

Rubber or foam coatings (not shown) can be placed on outer and/or inner surfaces to attenuate shock. In particular, the rubber or foam coatings can absorb shock in the case of the barrel deflecting to the extent that it engages the center tube. This is a concern mainly with polycarbonate barrels in the hands of strong players. These protective coatings (not shown) act to improve the function of the bat under conditions where the barrel does deflect and engage the center tube as well as to protect the center tube. In these cases, the ballast can advantageously be provided of a more rigid material to add structural strength to the ball bat and to the barrel assembly in particular.

The ballast tube 130 also serves as a tamper resistant shield. When it is desired to add little or no weight when configuring a bat, the ballast tube 130 could function primarily as a tamper resistant shield. In this case, the thin film material of the ballast tube can have a thickness in a range from approximately 1/100 to approximately 3/100 inch. (That is, in the range from approximately 10 to 30 thousandths of an inch in thickness.) The thickness of the ballast tube could be made as thick as one hundred and twenty-five thousandths of an inch. The ballast tube 130 can be made of a transparent material that enables ease of inspection through the ballast tube 130. To this end, lights, mirrors or other instruments, (including any of a variety of optical scopes that are known or yet to be discovered), can be used to view and detect modifications to an inner surface of the barrel section 115 without disassembling the barrel assembly 135. Furthermore, breaks in the ballast tube 130 would cause an inspector to suspect inappropriate modification of the bat. One of the advantages of the reconfigurable bats of the present invention is that they can be easily disassembled for inspection. With the embodiments incorporating the ballast tube 130, the barrel assembly 135 can be slid off as a unit for easy inspection of the center tube 110 as well as for checking the inner surface of the barrel 115.

FIG. 9H also shows engagement structures in the form of a transition nose 325 and an end cap nose 330 for receiving respective ends of the ballast tube 130. FIGS. 9A, 9C, and 9G show engagement structures in the form of noses 325 and 330 substantially similar to those of FIG. 9H. The noses 325, 330 can have chamfers 332, 334 as shown in FIG. 9H to ease installation of the ballast tube 130 on the noses 325, 330. Since the ballast tube is hollow, it does not impede insertion of the center tube 110 through the barrel assembly. Furthermore, the ballast tube 130 acts as a guide that facilitates insertion of the center tube into the end cap 125. This is so because the ballast tube 130 centers the distal end of the center tube 110 generally to within an eighth to a tenth of an inch, (the thickness of the nose wall.) The inner edge of the nose 330 could have a chamfer 336 as shown in FIG. 9C for additionally facilitating insertion of the center tube 110 during assembly. It should be noted that the noses 325, 330 could be replaced with any of a variety of alternative engagements structures such as recesses, for example.

The ballast tube/shield 130 could take other forms such as having a larger girth for positioning proximate to the inner wall of the barrel section 115. However, the noses 325, 330 provide an advantageous support for the ballast tube proximate to the center tube 110 as can be appreciated from FIGS. 91, 9C, and 9G. An adhesive can be used to bond the ends of the ballast tube 130 to the noses 325, 330. In this way, with the ballast tube 130 fixedly positioned proximate to the center tube 110, breaks in the thin film of the ballast tube 130 may be detected by tactile contact with a finger or a stick designed to detect such breaks. Any such break would cause an inspector to suspect modifications to the barrel section 110 such as adding or removing material therefrom. Thus, when a ballast tube 130 is incorporated, the invention has the advantage of enclosing and protecting the inner surface of the barrel section 115 against modification.

Figure 9I:
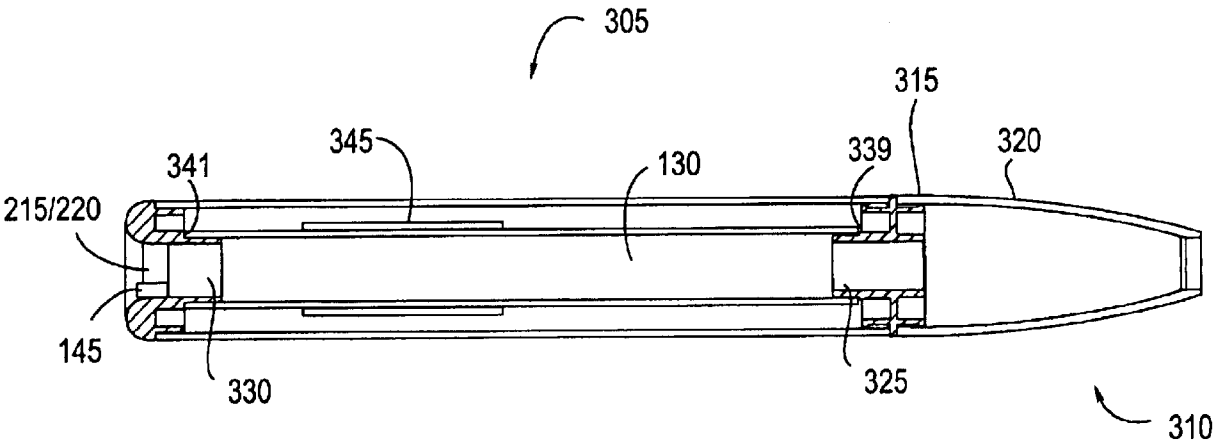
FIG. 9I is a sectional view of the barrel assembly of FIG. 9H in an assembled configuration.

FIG. 9I additionally shows steps 339, 341 in the noses 325, 330 for positively locating end edges of the ballast tube 130. In this way the weight distribution is more positively controlled. Furthermore, FIG. 91 shows how one or more additional layer(s) 345 of material can be added to the ballast tube to further control a weight distribution in the bat. The additional layer(s) could be adhesively bonded to the ballast tube 130 at a predetermined position. In this case, the weight is not evenly distributed. Alternatively, additional material such as layer 345 could be allowed to move so that the weight distribution during swinging of the bat will change. For example, the weight could be permitted rest at a more proximal position during a first part of a swing and move distally during the swing as momentum is increased. This would take advantage of a low swing weight for starting the swing and a higher wing weight for the moment of impact with a ball, for example. These and other configurations are considered to be within the scope of the present invention. A general principle is that the bat is reconfigurable and permits selectively choosing a bat size, weight, weight distribution, and play characteristics. At the same time the bat can be taken apart for easy inspection and selective reconfiguration. It should be noted that utilizing a ballast for selectively changing and/or distributing the weight can be implemented without changing the play characteristics of the barrel section 110 itself.

FIG. 9I also shows one of the ledges 215, 220 of the end cap 125. One of the anti-rotation fittings 145 is also depicted in a retaining position in the end cap 125. This is the position of the anti-rotation fitting 145 for blocking rotation of the end plug 140 when the end plug 140 (FIGS. 9B and 9C) is in its interlocked position. FIG. 91 also show the transition piece 310 in an assembled state with the radially extending short piece 315 snap locked together with the shell 320.

Figure 10A:
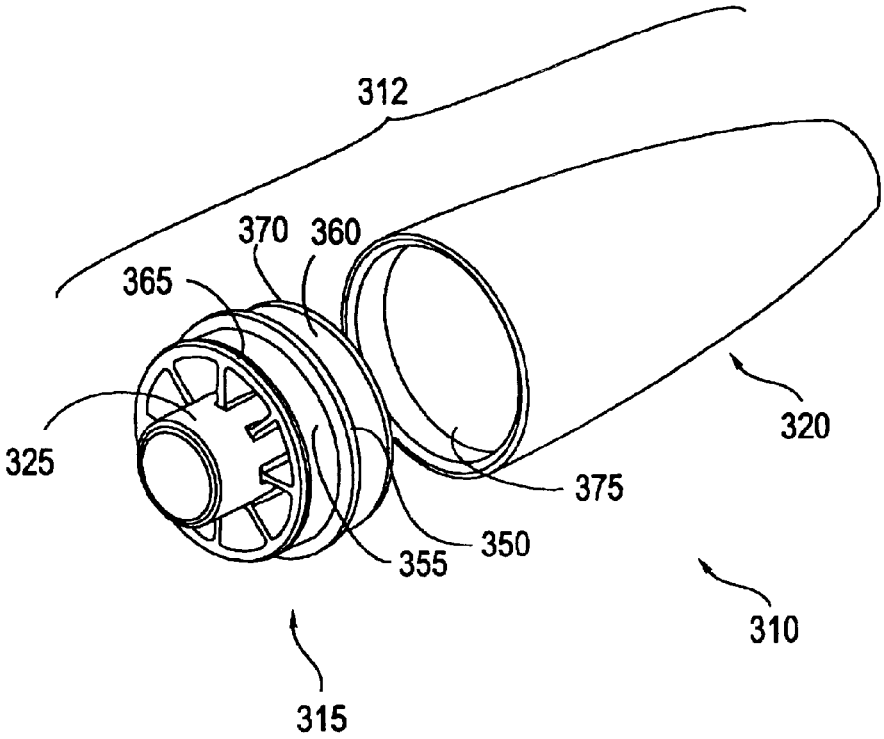
FIGS. 10A–10B are exploded perspective views of a transition piece useable with any of the embodiments having a transition piece that is formed as a piece that is separate from the barrel.
Figure 10B:
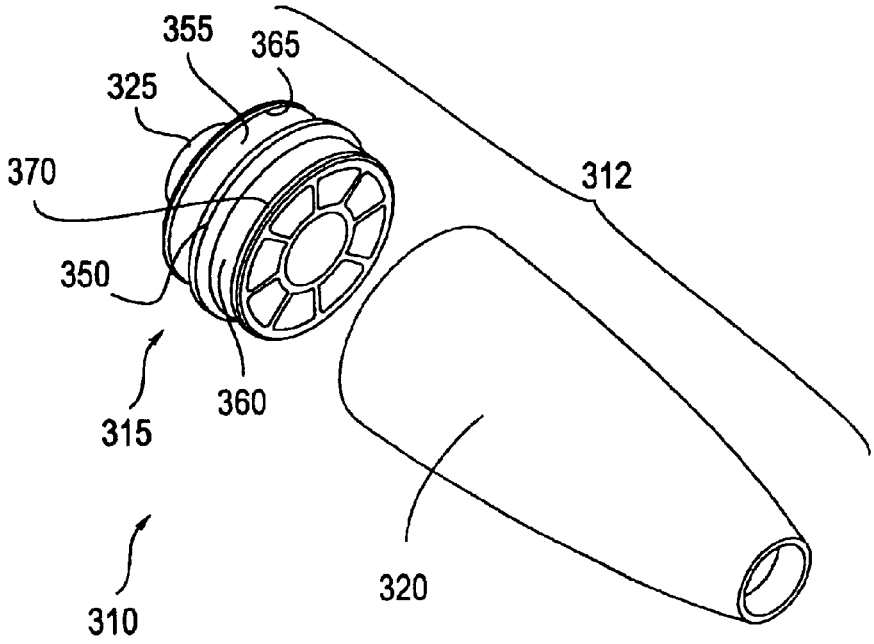
Figure 10C:
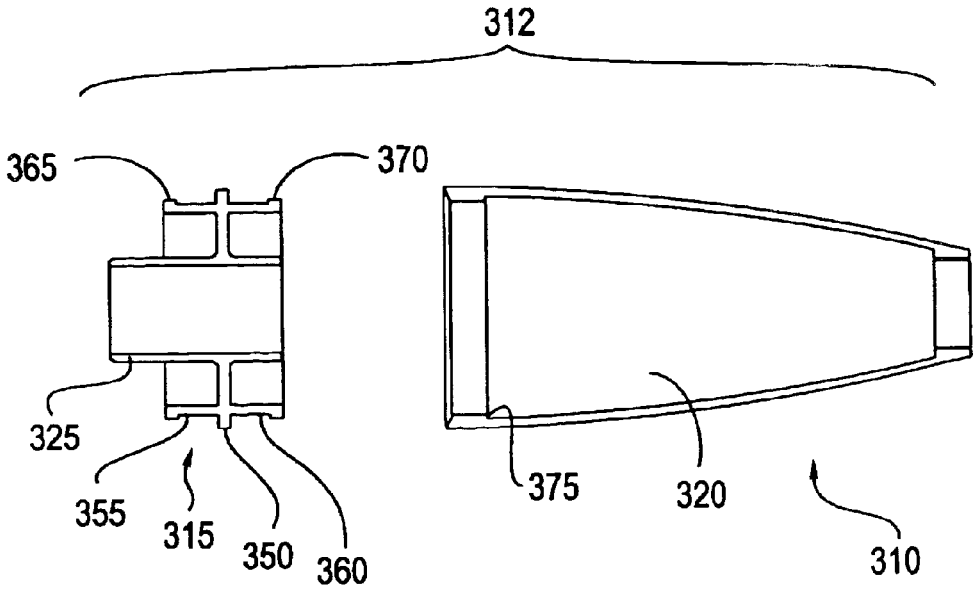
FIG. 10C is an exploded sectional view of the transition piece of FIGS. 10A–10B.

In particular, FIGS. 10A–10C show the transition piece 310 as a transition assembly 312. The transition assembly comprises a radially extending short piece 315 and a shell 320 as set forth above. A transition piece nose 325 extends from a distal end of the short piece 315. A radially extending flange 350 is positioned between an axially extending flange 355 protruding distally and an axially extending flange 360 protruding proximally. Each of these axially extending flanges 355, 360 has a radially extending protrusion 365, 370 for engaging the annular depression 255 in the barrel section 115 and an annular depression 375 in the shell 320 respectively. (See FIGS. 9H and 9I.) The radially extending protrusions 365, 370 and annular depressions 255, 375 provide respective snap lock fits intended to be generally permanent. These connections between the short piece 315 and each of the barrel section 115 and the shell 320 can be provided in addition to an adhesive bond as has been discussed with regard to other similar connections described above. Alternatively, one or the other of snap lock connections or adhesive connections can be provided.

Figure 11A:
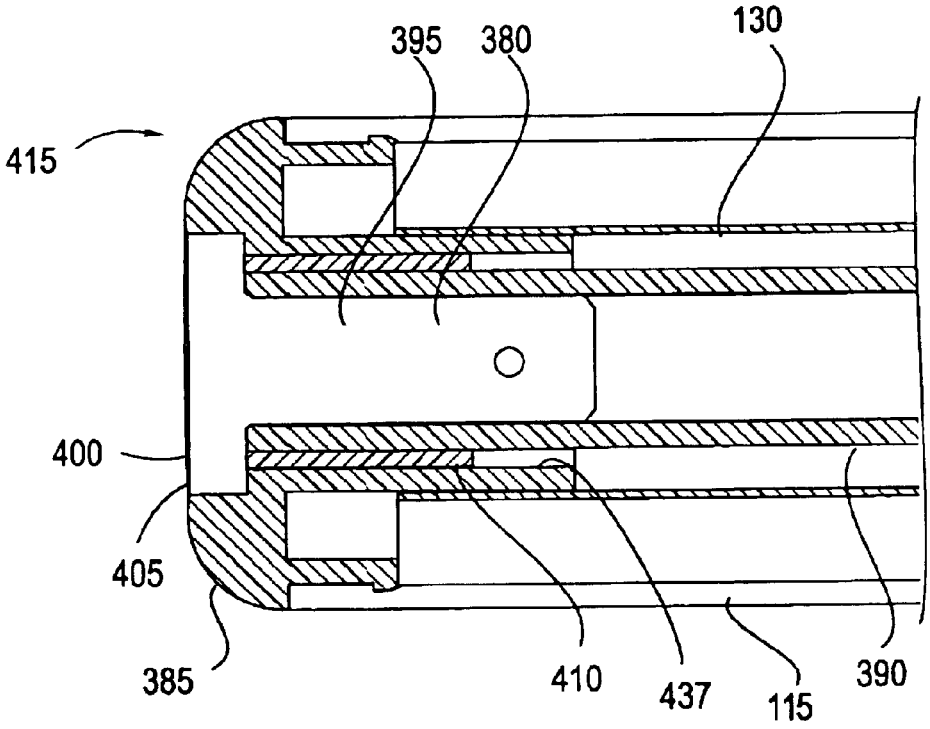
FIG. 11A is a sectional view similar to FIG. 9C, but depicting a sixth embodiment.

FIGS. 11A–11D show a sixth embodiment of the present invention with a modified end plug and related structure for enabling assembly of a barrel assembly on the center tube. FIG. 11A is a sectional view similar to FIG. 9C, but depicting the sixth embodiment end plug 380 and an associated end cap 385. The end plug 380 is fixed in a distal end of a center tube 390 in a similar manner to the end plugs of the previously described embodiments. The center tube 390 extends substantially a full length of the ball bat. In fact, the center tube 390 extends to a more distal position in the end cap 385 than in the previously described embodiments. As shown in FIG. 11A, the end plug 380 has a body 395 and a disk shaped head 400. A distal end edge of the center tube 390 extends to and abuts a proximal surface of the head 400. A distally facing portion of a recess 405 in the end cap 385 and an end edge of a spacer 410 that lies between the center tube 390 and the end cap 385 also abut the proximal surface of the head 400. In this way, the end plug 380 acts as a stop to inhibit distal movement for the spacer 410 and the end cap 385 relative to the center tube 390 and the end plug 380. Otherwise, the embodiment of FIG. 11A functions generally the same as the embodiment of FIGS. 9A–9I. It is to be understood that the head 400 can be of any of a variety of shapes. The head 400 simply needs to be larger than an opening in the end cap 385 so that the head cannot pass through the opening. Advantageously, the head 400 can be formed of a hexagonal or other non-circular shape and mate with structure in recess 405 in the end cap to inhibit relative rotational movement between the end cap 385 and the end plug 380. In one aspect, the non-circular shape of the head 400 can mate with a complimentary shape forming at least part of the recess 405 to inhibit rotational movement.

Figure 11B:
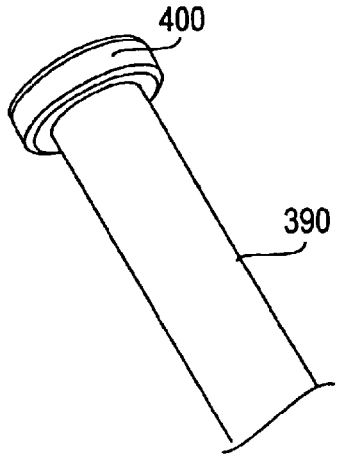
FIG. 11B is a sectional view similar to FIG. 9D, but showing the center tube and end plug of the sixth embodiment.
Figure 11C:
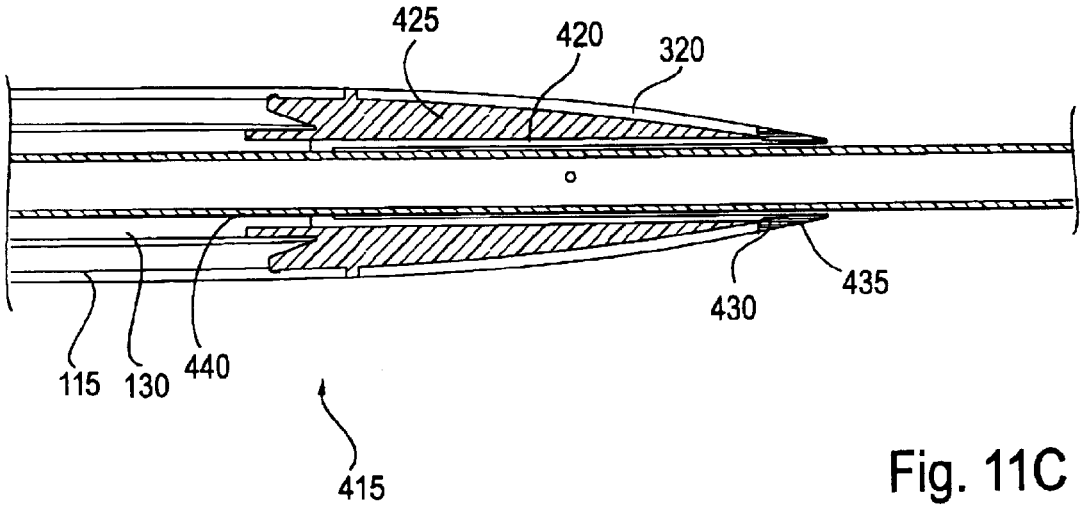
FIG. 11C is a sectional view similar to FIG. 9F, but showing the transition piece and associated components for the sixth embodiment.

As shown in FIGS. 11A and 11B, the shape and size of the head 400 of the end plug 380 does not permit the barrel assembly 415 of the present invention to be installed over the end plug 380. Rather, the barrel assembly 415 must be installed over a proximal end of the center tube 390 as will be described below. The end plug 380 also lacks structure for inhibiting movement of the end cap 385 in a proximal direction. Thus, a sleeve 420 is fixed to an outside of the center tube 390 at a position underlying a transition piece 425. The sleeve 420 may be made of aluminum or other material with a threaded portion 430 at a proximal end of the sleeve 420. A mating nut 435 engages the threaded portion 430 of the sleeve 420 and is tightened into abutting engagement with the transition piece 425. The transition piece 425 forms a part of the barrel assembly 415 and abuts the barrel section 115 in a similar manner to the previously described embodiments. Thus, the nut 435 holds the barrel assembly 415 and keeps it from moving proximally. The spacer 410 is needed since the end cap has to have a central bore 437 large enough to slide over the sleeve 420. The spacer 410 thus takes up space that would otherwise exist between the center tube 390 and the end cap 385.

The transition 425 is very similar to the transition 120 of FIGS. 9A–9G. However, a central bore 440 is larger to accommodate the sleeve 420 in the assembled state. It is to be understood that a similar transition piece to that shown in FIGS. 9H–10C could be substituted for the transition piece 425 with an equally beneficial result.

Figure 11D:
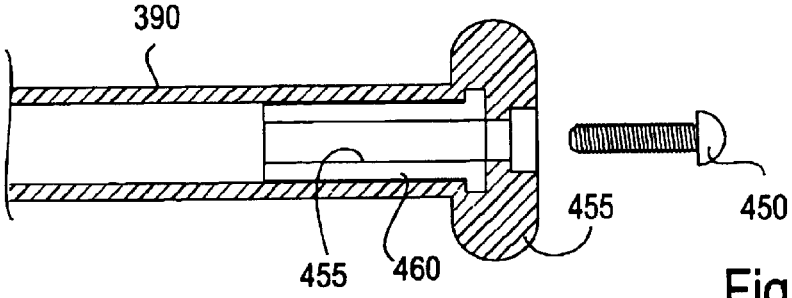
FIG. 11D is a sectional view of the knob end of the bat of the sixth embodiment.

FIG. 11D shows a removably mounted knob 445 mounted on the proximal end of the center tube 390. The knob is mounted by a screw 450 that engages a threaded bore 455 in a knob end plug 460 in a similar manner to the mounting of the end cap in FIG. 8B. This arrangement for the removable knob 445 is necessary since the barrel assembly 415 can only be installed by sliding it over the proximal end of the center tube 390. In order to install the barrel assembly 415, the knob 445 must be removed from the center tube 390. Then the end cap 385, barrel 115 and transition piece 425 can slide distally over the center tube 390. It is to be understood that the ballast tube 130 can be part of the barrel assembly 415 as in the other embodiments described above. It is to be further understood that the ballast tube can be provided in other parts of the ball bats for this or any of the other embodiments. For example, the ballast can be provided as a rod inside the center tube or in any form adhered to an inside of the barrel or to an outside of the center tube. Alternatively, the ballast can be omitted from this and any of the other embodiments without departing from the spirit and scope of the invention.

The materials for the various components may vary without departing from the spirit and scope of the invention. In addition to the materials set forth above, the barrels of the present invention can be formed of metal, plastics, or composites. In particular, a polycarbonate extrusion having an inner diameter of approximately two inches and an outer diameter of approximately two and a quarter inches has good performance and durability. Fiber reinforced and unreinforced polyurethane can also be used.

Interestingly, similar materials can also be used for forming the center tubes of the ball bats of the present invention. For example, high strength aluminum alloy or polycarbonate tubing can be covered with a layer of carbon or boron fibers. By way of example and not by way of limitation, the center tubes could include 2024-T3, 7075-T6, or 6068-T6 aluminum alloys. Further by way of example, the center tube can have a tube with an outer diameter of three quarters of an inch. The tube can further have an approximately 0.0375 inch thick prepreg fiber layer covering the outside of the tube. Alternatively, the fiber layer can be provided in thicknesses ranging from five to one hundred and twenty-five thousandths of an inch as desired. Thus, for a center tube of three quarters of an inch and a layer of prepreg, the resulting range of diameters is from approximately seven hundred fifty-five thousandths of an inch to approximately one inch. The tube could have an inner diameter from zero to just less than three quarters of an inch depending on the material(s) incorporated and their properties. Furthermore, these ranges can further vary since the center tube can have an outer diameter greater or less than three quarters of an inch. In one case the center tube can have an outer diameter in a range from approximately three quarters of an inch to approximately one inch. Similarly, the center tube can have an inner diameter in a range from approximately one half inch to approximately seven hundred and fifteen thousandths of an inch. The fibers may be aligned with the longitudinal axis for greater bending strength or may be angled more or less relative to the longitudinal axis to provide greater or lesser flexibility in the bat.

Figure 12A:
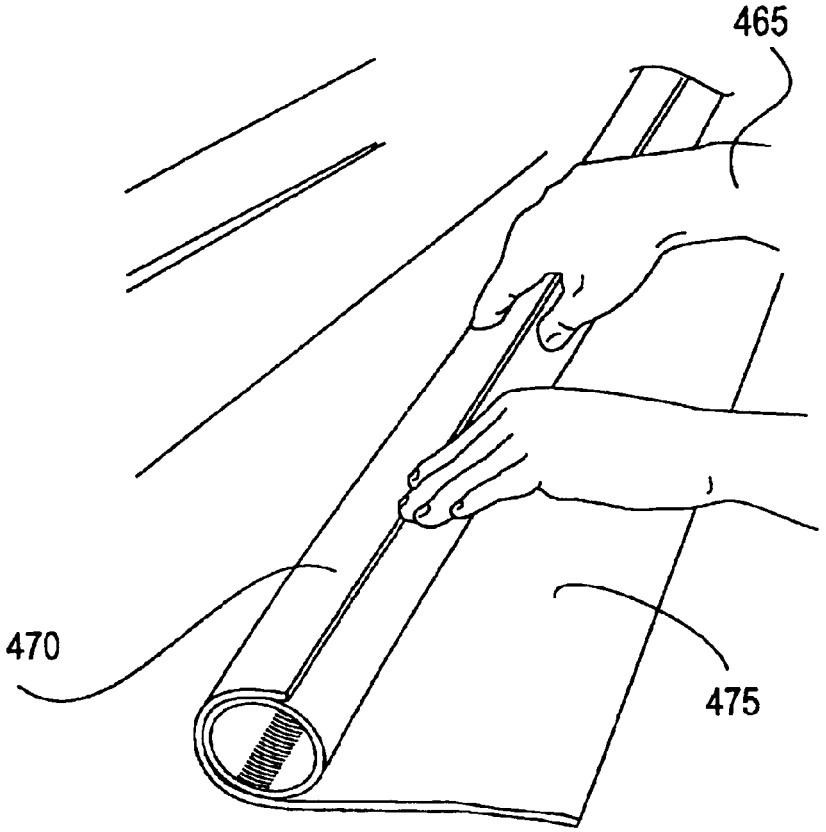
FIG. 12A is a perspective view depicting a step of adding a fiber layer to an exterior of the center tube.
Figure 12B:
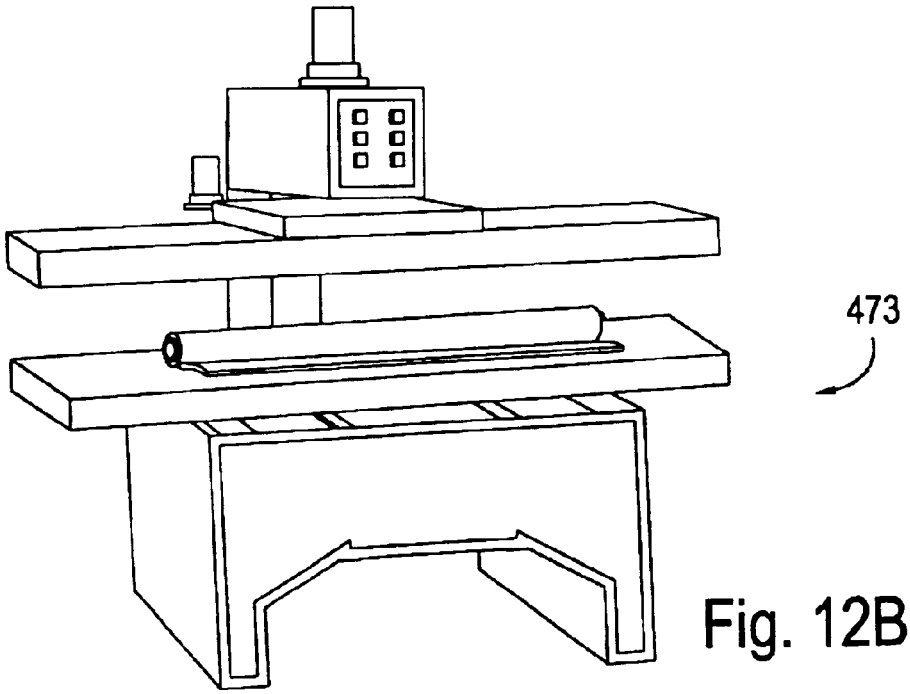
FIG. 12B is a perspective view of a rolling machine that is used to effect the step of adding the fiber to the center tube.

The fiber layer for composite center tubes is formed in a manner depicted in FIG. 12A. Here a person 465 prepares the tube 470 for rolling by a machine 473 like that shown in FIG. 12B. The person 465 starts rolling a sheet of prepreg fiber 475 on the tube 470 and then places the tube and sheet in the machine 473 for completion of the rolling step. Then the tube 470 and fiber layer are placed in a plastic coating material and cured by heating to adhere the fiber layer and provide the center tubes of the present invention in one of their forms. It should be noted that similar fiber layers could be applied to the barrel sections to achieve similar strengthening advantages.

It is to be understood that the snap lock connections of the present invention and described at various places throughout this disclosure could be substituted by threaded fitting connections, twist-lock fittings, or a stud or spring detent connection. The connections could also be made to resist rotation between mutually adjacent components that are joined together by the connections.

The center tubes, end plugs, nuts, and screws all exert tensile forces at much smaller radii than the barrel sections and their bearing surfaces. These tensile forces act to hold the various components of the bats together in a clamped configuration. Significant bending forces are kept from affecting these components of smaller radii because of the strength of the barrels, end caps, and transition pieces. The geometries and relationships between the barrels, end caps, and transition pieces spread the forces along the length of the center tube during impact. Specifically, a force of impact applied generally radially on the barrel is transferred at least in part to the end caps and transition pieces, which in turn transfer at least a portion of the force to the center tubes. However, the force of impact that is transferred to the center tube is transferred along an inner surface of the through holes of the end caps and along the inner surface of the transition pieces. This distributes bending forces that are not taken up by the barrels and other components over large areas of the center tubes and enables these bending forces to be taken up along substantially entire lengths of the center tubes. Thus, stress concentrations are avoided and the tendency to failure due to these forces is reduced.

One of the advantages of the present invention that is accomplished by all of the embodiments, to some degree, is that the reconfigurable ball bats all incorporate components that are more easily manufactured than are the components of the bats of the past. Thus, the bats can be made less expensively. Specifically, this is accomplished by forming one or more of the components that have complex shapes from a plurality of components having shapes that are easily machined or easily molded. For example, the barrel for all of the embodiments is a simple straight cylindrical component as opposed to the barrels of the past that transition into complex transition and butt end portions that require special machining. Similarly, the molded transitions and end caps are much more easily formed by molding than by machining as was required in the past. Forming couplings by molding is also less costly. Adhesively bonding the couplings to their respective barrel and transition pieces is a simple manufacturing step. The resulting advantage of providing a bat that can easily be dismantled and reconfigured is worth the additional manufacturing steps of assembling plural pieces. This is particularly so because the components can be made for far less than the components of bats of the past. Still further, the performance of the bats of the present invention is adjustable as set forth above.

Another aspect of the performance of the bats of the present invention is that the materials and configurations lend to a light weight bat. With most of the components formed of light weight composites as set forth above, the weight of the bats can easily be kept under thirty ounces. In fact, for most lengths of bats, it is possible to keep the weights in a range from twenty-two ounces to thirty ounces when incorporating the composite materials with an epoxy, thermoset, or thermoplastic matrix as set forth above. In particular, a polyurethane thermoset matrix material is beneficial in providing a strong light weight bond. Weight can be kept low by forming most or all of the larger components of the lighter weight composite components, while the smaller components such as end plugs and other couplers may be formed of denser materials such as aluminum or other materials.

As can be appreciated, a grip (not shown) will normally be provided on bats of all of the above described embodiments. Typically, this grip may be of any of a variety of relatively thin conventional materials and extend from the knob 16 distally a distance in the range from 10 inches to 15 inches.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, it is contemplated that many couplers and configurations of couplers could be provides in accordance with the above described principles without departing from the spirit and scope of the present invention.

What is claimed is:

1. A reconfigurable ball bat comprising:

a center tube including a handle portion;

a barrel assembly comprising:

a transition piece;

an end cap;

a barrel removably connected to the end cap at a distal end of the barrel, the barrel connected to the transition piece at a proximal end of the barrel; and wherein:

the barrel assembly is removably supported as a unit on the center tube by the transition piece and the end cap; and the transition piece forms a smooth, generally continuous radially outwardly facing surface together with at least a portion of the barrel.

2. The reconfigurable ball bat of claim 1, further comprising a ballast, wherein the ballast is concentric with and is disposed within the barrel.

3. The reconfigurable ball bat of claim 2, wherein:

the ballast has a tubular configuration; and the ballast is disposed between the barrel and the center tube.

4. The reconfigurable ball bat of claim 1, wherein the barrel has an inner diameter of approximately two inches and an outer diameter of approximately two and a quarter inches.

5. The reconfigurable ball bat of claim 1, wherein the barrel comprises a thermoplastic material.

6. The reconfigurable ball bat of claim 5, wherein the barrel comprises a polycarbonate material.

7. The reconfigurable ball bat of claim 5, wherein the barrel comprises a polyurethane material.

8. The reconfigurable ball bat of claim 6, wherein the barrel comprises a reinforcing material.

9. The reconfigurable ball bat of claim 1, wherein the center tube has an inner diameter in a range from approximately 0.500 inch to approximately 0.715 inch.

10. The reconfigurable ball bat of claim 1, wherein the center tube has an outer diameter in a range from approximately 0.75 inch to approximately 1.00 inch.

11. The reconfigurable ball bat of claim 1, wherein the center tube comprises an aluminum material.

12. The reconfigurable ball bat of claim 1, wherein the center tube comprises a composite material.

13. The reconfigurable ball bat of claim 12, wherein the center tube comprises an aluminum inner portion and a reinforcing fiber outer layer.

14. The reconfigurable bail bat of claim 1, wherein the center tube comprises a thermoplastic material.

15. The reconfigurable ball bat of claim 1, wherein the center tube is fiber reinforced.

16. The reconfigurable ball bat of claim 1, further comprising a ballast located interiorly of the barrel to provide a predetermined weight along a length of the barrel.

17. The reconfigurable ball bat of claim 16, wherein the ballast seals an inner surface of the barrel and surrounds the center tube.

18. A reconfigurable ball bat comprising:

a center tube including a handle portion;

an end plug having a body in a form of a shaft and a head connected to the body;

the body fixed in a distal end of the center tube;

the head protruding from the distal end of the center tube and engaged with an end cap; and a barrel assembly comprising:

a transition piece;

the end cap; and a barrel removably connected to the end cap at a distal end of the barrel, the barrel connected to the transition piece at a proximal end of the barrel;

wherein the barrel assembly is removably supported as a unit on the center tube by the transition piece and the end cap.

19. The reconfigurable ball bat of claim 18, further comprising:

an elongate slot in the end cap;

the head having an elongate configuration; and wherein the head fits into the slot in an interlocking relation.

20. The reconfigurable ball bat of claim 19, further comprising at least one anti-rotation fitting inserted in the elongate slot and holding the head in the interlocked relation against rotation.

21. The reconfiguration ball bat of claim 20, wherein the at least one anti-rotation fitting is held in the elongate slot by a set screw engaging the anti-rotation fitting and the end plug.

22. The reconfigurable ball bat of claim 18, further comprising:

an opening in the end cap for receiving the center tube therethrough;

wherein the head of the end plug is larger than the opening in the end cap and cannot pass through the end cap so that the end cap is mounted on the center tube by passing the end cap over a proximal end of the center tube with a knob removed.

23. The reconfigurable ball bat of claim 22, further comprising:

a threaded element on the center tube;

a nut for engagement with the threaded element;

wherein the barrel assembly including the end cap is passed over the proximal end of the center cube and moved distally until the end cap engages the head of the end plug;

the barrel assembly is held in place on the center tube by the nut after the barrel assembly and the nut have been moved distally over the center tube.

24. The reconfigurable ball bat of claim 22, wherein the head further comprises a non-circular structure engaged with structure in the end cap to prevent relative rotational movement between the end cap and the end plug.

25. A reconfigurable ball bat comprising:

a barrel assembly comprising:

a transition piece;

an end cap;

a barrel removably connected to the end cap at a distal end of the barrel, the barrel connected to the transition piece at a proximal end of the barrel; and a ballast supported on the end cap and the transition piece; wherein:

each of the end cap and transition piece has a engagement structure; and the ballast enfages the engagement structure on each of the end cap and the transition piece.

26. A reconfigurable ball bat comprising:

a barrel assembly comprising:

a transition piece;

an end cap; and a barrel removably connected to the end cap at a distal end of the barrel, the barrel connected to the transition piece at a proximal end of the barrel;

wherein:

the end cap and the transition piece have respective bearing surfaces each with the same minimum diameter; and the barrel is a straight cylindrical barrel and engages each of the end cap and the transition piece at the minimum diameter.

27. A reconfigurable ball bat comprising:

a barrel assembly comprising:

a transition piece;

an end cap; and a barrel removably connected to the end cap at a distal end of the barrel, the barrel connected to the transition piece at a proximal end of the barrel;

wherein the transition piece comprises two connectable concentric parts joined together and the two parts comprise a generally frustoconical part and a radially extending part supporting the frustoconical part in a coaxial configuration.

28. A reconfigurable ball bat kit, comprising:

a barrel assembly including:

a barrel;

an end cap adapted to be supported on the barrel;

a transition piece adapted to be supported on the barrel and removably supported on a handle portion of the ball bat; and a ballast adapted to be supported on the end cap and on the transition piece inside the barrel.

29. The reconfigurable ball bat kit of claim 28, wherein the ballast is coaxial with the barrel in an assembled state.

30. The reconfigurable ball bat kit of claim 28, wherein the ballast has a predetermined weight.

31. The reconfigurable ball bat kit of claim 29, wherein:

the end cap has a distal engagement structure;

the transition piece has a proximal engagement structure, and the ballast is supported at a distal end and at a proximal end by the distal engagement structure and the proximal engagement structure respectively in an assembled state.

32. The reconfigurable ball bat kit of claim 31, wherein the ballast is fixed to each of the distal engagement structure and the proximal engagement structure.

33. The reconfigurable ball bat kit of claim 28, wherein the ballast is a thin film tubular member having a thickness in a range from ten to one hundred and twenty-five thousandths of an inch.

34. The reconfigurable ball bat kit of claim 28, wherein:

the barrel assembly is a first barrel assembly; and the reconfigurable ball bat kit further comprising a plurality of barrel assemblies including the first barrel assembly.

35. The reconfigurable ball bat kit of claim 34, wherein each of the plurality of barrel assemblies has a different weight characteristic from at least another of the barrel assemblies.

36. A reconfigurable ball bat kit, comprising:

a barrel assembly including:

a barrel;

an end cap adapted to be supported on the barrel; and a transition piece adapted to be supported on the barrel and removably supported on a handle portion of the ball bat;

wherein the transition piece comprises two connectable concentric parts adapted to be joined together and the two parts comprise a generally frustoconical part and a radially extending part for supporting the frustoconical part in a coaxial configuration.

37. A method of using a reconfigurable ball bat, the bat having:

a center rube and a barrel assembly removably mounted on the center tube;

the method of using the reconfigurable ball bat comprising:

inserting the central tube through the barrel assembly and twisting the center tube relative to the barrel assembly;

inserting at least one anti-rotation fitting into the end cap; and securing the anti-rotation fitting in the end cap by a set screw.

38. A method of making a reconfigurable ball bat, the method comprising:

performing preliminary steps of assembling a barrel assembly, the preliminary steps including:

connecting a transition piece to a proximate end of a barrel;

connecting a proximal end of a ballast to an engagement structure of the transit on piece;

connecting a distal end of the ballast to a engagement structure of an end cap; and connecting an end cap to a distal end of the barrel; and supporting the barrel assembly on a center tube by inserting the center tube through the transition piece, the ballast, and the end cap.

39. The method of claim 38, wherein the step of supporting further comprises:

inserting the center tube through the transition piece before inserting the center tube through the ballast and the end cap; and inserting the center tube through the ballast before inserting the center tube through the end cap.

40. The method of claim 38, further comprising:

a preliminary step of fixing an end plug in a distal end of the center tube; and connecting the end plug to the end cap.

41. A method of making a reconfigurable ball bat, the method comprising:

performing preliminary steps of assembling a barrel assembly, the preliminary steps including:

connecting a transition piece to a proximate end of a barrel;

connecting an end cap to a distal end of the barrel; and fixing an end plug in a distal end of a center tube; and supporting the barrel assembly on the center tube by:

inserting the center tube through the transition piece, barrel, and the end cap; and, connecting the end plug to the end cap;

wherein the step of connecting the end plug to the end cap comprises:

interlocking the end plug with the end cap; and securing the end plug in an interlocked position with at least one anti-rotation fitting and at least one set screw.

42. The method of claim 41, wherein the step of interlocking further comprises:

inserting the end plug through the end cap; and twisting the center tube and end plug approximately ninety degrees.

43. The method of claim 41, wherein:

the at least one anti-rotation fitting is a first anti-rotation fitting;

the at least one set screw is a first set screw; and the step of connecting the end plug to the end cap further comprises securing the end plug in an interlocked position with at least two anti-rotation fittings including the first anti-rotation fitting and at least two set screws including the first set screw.

44. A method of making a reconfigurable ball bat, the method comprising:

performing preliminary steps of assembling a barrel assembly, the preliminary steps including:

connecting a transition piece to a proximate end of a barrel; and connecting an end cap to a distal end of the barrel;

supporting the barrel assembly on a center tube by inserting the center tube through the transition piece, the barrel, and the end cap;

screwing a nut on a sleeve to hold the transition piece against movement in a proximal direction after the step of supporting; and connecting a knob at a proximal end of the center tube.

45. A method of making a reconfigurable ball bat, the method comprising:

performing preliminary steps of assembling a barrel assembly, the preliminary steps including:

assembling a transition piece from two concentric pieces;

connecting the transition piece to a proximate end of a barrel;

connecting an end cap to a distal end of the barrel; and supporting the barrel assembly on a center tube by inserting the center tube through the transition piece, the barrel, and the end cap.

46. The reconfigurable ball bat kit of claim 34, wherein each of the plurality of barrel assemblies has a different playability characteristic from at least another of the barrel assemblies.

* * * * *

UNITED STATES PATENT AND TRADEMARK OFFICE

CERTIFICATE OF CORRECTION

PATENT NO. : 6,875,137 B2
DATED : April 5, 2005
INVENTOR(S) : Forsythe et al.

It is certified that error appears in the above-identified patent and that said Letters Patent is hereby corrected as shown below:

Column 24,
Line 36, change “cube” to read -- tube --.
Line 59, change “enfages” to read -- engages --.

Column 26,
Line 6, change “rube” to read -- tube --.
Line 32, change “transition” to read -- transition --.

Signed and Sealed this

Twenty-eighth Day of June, 2005

JON W. DUDAS
*Director of the United States Patent and Trademark Office*